US008328614B2

(12) United States Patent
Jones et al.

(10) Patent No.: US 8,328,614 B2
(45) Date of Patent: Dec. 11, 2012

(54) GAMING SYSTEM, GAMING DEVICE AND METHOD FOR PROVIDING A WAGERING SOLITAIRE GAME

(75) Inventors: Aaron T. Jones, Reno, NV (US); James A. Vasquez, Carson City, NV (US); Bryan D. Wolf, Reno, NV (US); Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 1194 days.

(21) Appl. No.: 12/104,053

(22) Filed: Apr. 16, 2008

(65) Prior Publication Data

US 2009/0124334 A1 May 14, 2009

Related U.S. Application Data

(60) Provisional application No. 60/986,509, filed on Nov. 8, 2007.

(51) Int. Cl.
*A63F 1/00* (2006.01)

(52) U.S. Cl. ..... 463/11; 463/16; 463/23; 273/292

(58) Field of Classification Search ..... 463/11, 463/16, 23; 273/292
See application file for complete search history.

(56) References Cited

U.S. PATENT DOCUMENTS

| | | | |
|---|---|---|---|
| 631,050 | A | 8/1899 | Peck |
| 2,334,093 | A | 11/1943 | Hickey |
| 2,896,951 | A | 7/1959 | Snow |
| 3,224,780 | A | 12/1965 | Mohl |
| 3,563,551 | A | 2/1971 | Weisbecker |
| 4,006,905 | A | 2/1977 | Marbury |
| 5,653,635 | A | 8/1997 | Breeding |

(Continued)

FOREIGN PATENT DOCUMENTS

WO WO 2005/002599 3/2005

(Continued)

OTHER PUBLICATIONS

"Freeware Solitaire A collection of freeware Solitaire card games for Windows," published at least as early as Feb. 9, 2006, available at http://web.archive.org/web/20060209005438/http:/solitaire.vegard2.no/, p. 1.*

(Continued)

*Primary Examiner* — Dmitry Suhol
*Assistant Examiner* — Jay Trent Liddle
(74) *Attorney, Agent, or Firm* — Neal, Gerber & Eisenberg LLP

(57) ABSTRACT

The present disclosure provides a method of determining suitable paytables for wagering Solitaire games or type games and a gaming system, gaming device and method for providing such wagering games with such paytables. In one embodiment, the paytable includes the outcomes in the form of ranges of the total numbers of cards which are banked at the time play terminates and the awards associated with each range. In various embodiments, the paytable is constructed such that certain of the awards increase non-linearly as the ranges of numbers of banked cards increase. In other words, in various embodiments, certain awards in the paytable have a different upper ratio to the number of cards banked than other awards in the paytable. In various embodiments, the Solitaire game includes one stage or multiple stages. The present disclosure also provides a paytable for multiple related plays of the Solitaire game.

52 Claims, 28 Drawing Sheets

90

| Cards Banked | First Stage Award | Second Stage Pays X 5 | Third Stage Pays X 20 with Enhanced Pay |
|---|---|---|---|
| 0 | 100 | 500 | 2,000 |
| 5 to 9 | 35 | 175 | 700 |
| 10 to 14 | 50 | 250 | 1,000 |
| 15 to 19 | 100 | 500 | 2,000 |
| 20 to 24 | 200 | 1,000 | 4,000 |
| 25 to 29 | 400 | 2,000 | 8,000 |
| 30 to 34 | 750 | 3,750 | 15,000 |
| 35 to 49 | 1,000 | 5,000 | 20,000 |
| 50 to 52 | 2,000 | 10,000 | Enhanced Pay 500,000 |

U.S. PATENT DOCUMENTS

| | | | | |
|---|---|---|---|---|
| 5,660,393 | A | 8/1997 | Dreger | |
| 5,816,917 | A | 10/1998 | Kelmer et al. | |
| 5,882,258 | A | 3/1999 | Kelly et al. | |
| 6,007,426 | A | 12/1999 | Kelly et al. | |
| 6,129,632 | A | 10/2000 | Luciano | |
| 6,179,291 | B1 | 1/2001 | Vancura | |
| 6,179,711 | B1 | 1/2001 | Yoseloff | |
| 6,283,855 | B1 | 9/2001 | Bingham | |
| 6,312,334 | B1 | 11/2001 | Yoseloff | |
| 6,322,445 | B1 | 11/2001 | Miller | |
| 6,368,214 | B1 | 4/2002 | Luciano | |
| 6,454,651 | B1 | 9/2002 | Yoseloff | |
| 6,554,282 | B2 | 4/2003 | VanderKley et al. | |
| 6,569,013 | B1 * | 5/2003 | Taylor | 463/13 |
| 6,612,927 | B1 | 9/2003 | Slomiany et al. | |
| 6,739,970 | B2 | 5/2004 | Luciano | |
| 6,780,104 | B2 | 8/2004 | Fox | |
| 7,094,152 | B2 | 8/2006 | Rush et al. | |
| 7,185,891 | B2 | 3/2007 | Jackson | |
| 7,264,244 | B1 | 9/2007 | Moy | |
| 2002/0052229 | A1 * | 5/2002 | Halliburton et al. | 463/9 |
| 2004/0204246 | A1 | 10/2004 | Halliburton et al. | |
| 2006/0027965 | A1 * | 2/2006 | Kane | 273/269 |
| 2006/0046836 | A1 | 3/2006 | Walker et al. | |
| 2008/0200239 | A1 * | 8/2008 | Gilmore et al. | 463/22 |
| 2010/0261519 | A1 * | 10/2010 | Zapata et al. | 463/22 |

FOREIGN PATENT DOCUMENTS

| | | |
|---|---|---|
| WO | WO 2005/123206 | 12/2005 |
| WO | WO 2006/017516 | 2/2006 |
| WO | WO 2006/088498 | 8/2006 |
| WO | WO 2006088498 A1 * | 8/2006 |

OTHER PUBLICATIONS

Canfield (solitaire) printed from http://en.wikipedia.org/wiki/Canfield_(solitaire) on Feb. 4, 2008.

Solitaire: Man Versus Machine written by Yan et al, available at least as early as Apr. 14, 2008.

Klondike (solitaire) printed from htto://en.wikipedia.org/wiki/Klondike_(solitaire) on May 14, 2007.

Solitaire written by http://en.wikipedia.org/wiki/Solitaire printed Jan. 22, 2007.

1-Card Casino Solitaire printed from http://www.casinoglamour.com/rules/solitaire.html on Jan. 30, 2007.

3-Card Casino Solitaire printed from http://www.casinoglamour.com/rules/solitaire.html?p=2 on Jan. 30, 2007.

1-Card Vegas Solitaire printed from http://www.casinoglamour.com/rules/solitaire.html?p=3 on Jan. 30, 2007.

3-Card Vegas Solitaire printed from http://www.casinoglamour.com/rules/solitaire.html?p=4 on Jan. 30, 2007.

Klondike printed from http://ww.solitairegames.com/Klondike.html on Jan. 30, 2007.

Online Solitaire Game Rules, Online Casion UK printed from http://casino.oddschecker.com/casino-game-review/game/solitaire on Jan. 30, 2007.

Rules of Solitaire Games printed on http://ww.solitairegames.com/rules.html on Jan. 30, 2007.

Solitaire and Patience games Rules—VIP Online Casino printed from http://www.vipcasino.com/help/rules/casino_solitaire.html on Jan. 30, 2007.

Solitaire Strategy printed from http://www.chessandpoker.com/solitaire strategy.html copyrighted in 2000.

Solitaire (Windows) printed from http://wikipedia.org/wiki/Solitaire_(Windows) on Apr. 14, 2008.

Diamond Solitaire Article in Strictly Slots written by Konami published Sep. 2004.

* cited by examiner

FIG. 4

118

| | |
|---|---|
| Total Games Played ("N") | 1540 |
| Total Games Solved | 24 |
| Total Cards Banked | 13,147 |
| Average Cards Banked | 8.22 |
| Average Moves to Solve | 48 |
| Highest Moves to Solve | 104 |
| Total Hearts Banked | 4249 |
| Average Hearts Banked | 2.75 |
| Total Diamonds Banked | 3708 |
| Average Diamonds Banked | 2.41 |
| Total Spades Banked | 3000 |
| Average Spades Banked | 1.95 |
| Total Club Banked | 1713 |
| Average Club Banked | 1.11 |

FIG. 5A

90

| Cards Banked | First Stage Award | Second Stage Pays X 5 | Third Stage Pays X 20 with Enhanced Pay |
|---|---|---|---|
| 0 | 100 | 500 | 2,000 |
| 5 to 9 | 35 | 175 | 700 |
| 10 to 14 | 50 | 250 | 1,000 |
| 15 to 19 | 100 | 500 | 2,000 |
| 20 to 24 | 200 | 1,000 | 4,000 |
| 25 to 29 | 400 | 2,000 | 8,000 |
| 30 to 34 | 750 | 3,750 | 15,000 |
| 35 to 49 | 1,000 | 5,000 | 20,000 |
| 50 to 52 | 2,000 | 10,000 | Enhanced Pay 500,000 |

Start
112
Shuffle the Deck
114
Deal the Cards
116
Check Field Move Strategies
120
Update History
130
Found Move ?
122
Yes
Make Move
132
No
Check Discard Pile Move Strategies
124
Found Move ?
126
Yes
Make Move
134
No
Game Over ?
128
No
Turn Over Next Card
136
Yes
Update History
138

GAMING SYSTEM, GAMING DEVICE AND METHOD FOR PROVIDING A WAGERING SOLITAIRE GAME

PRIORITY CLAIM

This application claims priority to and the benefit of provisional U.S. Application No. 60/986,509, filed on Nov. 8, 2007, the entire contents of which are incorporated herein by reference.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Solitaire is a family of well-known single-player card games which are generally similar in character, but vary in detail. One widely known solitaire game is Klondike, sometimes referred to herein as "Klondike Solitaire."

Klondike Solitaire utilizes a conventional deck of 52 playing cards. To begin a play of a game of Klondike Solitaire, 28 cards of the 52 card deck are dealt into seven piles. Each pile occupies a position. The first pile includes one card, the second pile includes two cards, and so on up to seven cards in the seventh pile. The top card of each pile is dealt face up and the other cards in each pile are dealt face down. The space the piles occupy is sometimes referred to as the "field."

The remaining 22 cards of the 52 card deck, which were not dealt into the initial seven piles, are referred to as stock cards. The stock cards are left face-down in a stock pile. The stock cards are turned up from the stock pile sequentially during game play. In certain versions of Klondike Solitaire, the stock cards are turned face up one at a time. In other versions, the stock cards are turned face up three at a time (i.e., every third card is turned face up). In some versions of Klondike Solitaire, the player may run through the stock cards one time during a play of the game. In other versions, the player may run through the stock cards multiple times during a play of the game.

Klondike Solitaire also includes four banks positioned above the seven piles. Klondike Solitaire includes one bank for each suit of cards (i.e., one for each of diamonds, hearts, spades and clubs). When the cards are initially dealt, these four banks or positions do not have any cards in them. Cards can only be placed in each respective bank or position in order (i.e., ace, two, three . . . King).

The ultimate objective of Klondike Solitaire is to accumulate all 52 cards of the deck into the respective banks. Cards must be accumulated in each respective bank in-suit and in ascending sequence (i.e., ace to king of the respective suit). A player completes or solves the Klondike Solitaire game when each bank includes all 13 cards of its respective suit. Placing a card in a bank or causing a card to be placed in a bank is sometimes referred to as "banking" a card. To accomplish this objective, a player may move or cause the movement of the cards according to a designated set of governing rules which are generally explained below.

The movement of the cards are governed by specific rules. When the stock cards are turned face up (as discussed below), they are placed in a discard pile, placed in the field or placed in one or more of the banks. A player may move cards from the stock pile, the discard pile and the field into the banks according to these rules, after they are turned up. Once turned up, the stock cards may also be moved to the field or the discard pile, according to these rules. Cards from the discard pile may be moved to the field or placed into a bank. A player may move face-up cards in any of the piles in the field either to another pile in the field or into a bank. A series of rules also govern the arrangement of cards in the field.

More specifically, a player may associate a number of cards with the face-up card on the top of each pile by "building" cards into a column. In Klondike Solitaire, cards must be built in descending sequence and alternating in color (i.e., red from black or black from red). For example, if the king of spades is face up on the top of a pile, a player may build a queen of hearts or a queen of diamonds onto the king of spades.

A player may move a face-up card from one pile or column to another pile or column, within these guidelines. Multiple face-up cards from one column may be built onto another pile or column as a unit. For example, if a column includes a seven of clubs and an eight of diamonds, a player may move these two cards together and build them onto a nine of spades or nine of clubs on another pile or at the bottom of another column.

When the player uncovers a face-down card on a pile, that card may be turned face up. The player is always entitled to seven piles. Thus, if no cards remain in the position of a pile, the player may put a king in that pile or position to start the pile.

A card may not be placed in a bank from the field unless it is "free." Cards which are free include cards which are face-up and either not associated with any other cards or the lowest card in a column. For example, if a built column includes a king of spades, a queen of hearts and a jack of spades, and a ten of spades is already in the bank associated with spades, then the jack of spades is "free" and may be moved into its respective bank.

Klondike Solitaire is a very popular game and is probably one of the best-known and most played solitaire games in the world. This game is played with conventional decks by hand by millions of people and played on millions of personal computers, handheld communication devices and other electronic devices worldwide.

While simple to play (i.e., moving cards subject to the governing rules), Klondike Solitaire is extremely complicated. Some estimates are that there are billions of possible different ways that a Klondike Solitaire game can be played with a standard 52 card deck based on the order of the cards and the movements of the cards by the player. Despite the vast popularity of this game, the exact proportion of Klondike games that will be won is currently unknown because no mathematical model known to the inventors is simple enough to allow direct computation of such exact probability or probabilities. No consensus also exists as to the probabilities associated with various non-winning game outcomes for each play of the game (i.e., the probability associated with having each of a number of less than 52 cards banked at the end of a game or before a player can not make any further moves of the cards). Similarly, formulas for determining such probabilities within suitable determinable margins of error or limited tolerances are not known. This is because of the amount of variables. Casino or gambling games typically require all of the exact probabilities or probabilities within limited tolerances of winning a game to be known, calculated and verifiable. For example, three wheel slot games typically have the exact probabilities worked out. Because the probabilities of Klondike Solitaire games are not known or calculated (within suitable tolerances) even with intense study, Klondike Solitaire has not been made into a suitable casino or wagering game.

Moreover, while such probabilities are not exactly known or known within suitable determinable margins of error or limited tolerances, it is somewhat known that people solve or complete the game about one in forty-five plays. Thus, another problem with making Klondike Solitaire a casino game is that a relatively big award can not be associated with solving the game because it happens too often.

More specifically, to create a suitable Klondike Solitaire wagering game, one would have to create a suitable paytable. Paytables are typically created to achieve a suitable designated average expected payback percentage and thereby be verifiable and approvable by gaming regulatory agencies. The average expected payback percentage of a paytable is a function of the respective exact probabilities or probabilities within limited tolerances of the player achieving each and every of the outcomes in the paytable and the respective awards associated with those outcomes.

Thus, to create a suitable paytable for a Klondike Solitaire game, one would need to know the exact probabilities of or have verifiable probabilities with limited tolerances associated with each of the various outcomes or events one seeks to include in the paytable. Absent these exact or verifiable probabilities (with limited tolerances), awards associated with those outcomes are difficult, if not impossible, to calculate such that the paytable achieves a suitable designated average expected payback percentage.

It is noted that in some land-based and online casinos, Las Vegas Solitaire is played. Las Vegas Solitaire is similar to Klondike Solitaire. In Las Vegas Solitaire, the player turns over stock cards one at a time, and is only allowed to go through the stock pile once. The player is provided with an award for each card successfully banked. In one known version, it costs the player 52 credits to play a game. The game pays 5 credits for each card banked. To break even, the player needs to bank 10 cards before going through the stock pile one complete time. The players are awarded as play progresses by the cards banked.

Accordingly, a need exists for (a) a method for determining the suitable probabilities within acceptable tolerances associated with the various Klondike Solitaire outcomes based on various strategies and rules of play; and (b) at least one paytable based on these probabilities which achieves a suitable designated average expected payback percentage.

Also, a need exists for a gaming device including a suitable wagering Klondike Solitaire game associated with such a paytable.

SUMMARY

The present disclosure provides a method of determining suitable paytables for wagering Klondike Solitaire games or type games and a gaming system, gaming device and method for providing such wagering games with such paytables.

One embodiment of the present disclosure includes an optimizer which is used to determine the probabilities within limited tolerances of each of the possible outcomes which can result from plays of the desired Klondike Solitaire game based on designated rules or a designated set of rules for that game. The determined probabilities and a desired payback percentage are employed to determine a paytable for the game. In one embodiment, the paytable includes the outcomes in the form of ranges of the total numbers of cards which are banked at the time play terminates and the awards associated with each range.

In various embodiments of the paytable, the ratio of at least one award to a respective: (a) number of cards banked; (b) lowest number of cards in a range of numbers of cards banked; (c) highest number of cards in a range of numbers of cards banked; and (d) total number of cards in a range of numbers of cards banked is different than that for other awards in the paytable. For example, in one embodiment of the paytable, the ratio of a first award to a first number of cards banked associated with that award is different than the ratio of a second, different award to a second, different number of cards banked associated with the second award.

The present disclosure includes a gaming system, gaming device and methods for playing a Klondike Solitaire game according to a set of rules and providing awards to a player which are determined by a paytable created using such an optimizer. In the respective various embodiments, the set of rules governing play of the Klondike Solitaire game utilized by the optimizer are the same as the set of rules governing play of the Klondike Solitaire game played on the gaming system or device.

In various embodiments, the Klondike Solitaire game includes one stage or multiple stages. In one embodiment disclosed herein, the game includes multiple stages. In this embodiment, if the player wins, completes or solves the Klondike Solitaire game, the player advances to a next stage of play, wherein the player is dealt a new Klondike Solitaire game. In this embodiment, the player continues to advance in such a manner upon winning each respective stage until no further stages remain. It should be appreciated that in other embodiments, a player may advance to subsequent stages independent of the result of previous stages based on other designated game events or upon an additional wager.

In various embodiments, the present disclosure also provides a paytable for multiple related plays of the Klondike Solitaire game. This paytable includes example Klondike Solitaire game outcomes and respective awards associated with those outcomes for three stages of play or three plays of the game. Such a paytable is what primarily enables solitaire to be made into a wagering casino game. As discussed above, it is somewhat known that people solve or complete a Klondike Solitaire game about one in forty-five plays. Thus, a problem facing the inventors in making Klondike Solitaire a casino game was that a relatively big award could not be associated with solving the game because it happens too often. Based on the estimate of one solve of a Klondike Solitaire game per forty-five plays, the probability of a player solving three consecutive games would be approximately one in 91,125 plays [(1/45)*(1/45)*(1/45)]. This lower probability, which is accomplished by enabling the player to play, in this example, three consecutive games, allows a relatively much larger award to be associated with solving the game in a third stage of play.

In various embodiments, the paytable includes outcomes applicable to three stages of play or plays of the game and three different awards associated with each of those outcomes, each of the different awards associated with a different stage of play or play of the game.

The present disclosure thus provides the ability to create paytables for different Klondike Solitaire games which each achieve a suitable desired average expected payback percentage and enable such wagering Klondike Solitaire games to be commercially implemented in casinos, other gaming establishments and through data networks such as the internet.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE FIGURES

FIG. 4 is an example of a history output by an optimizer disclosed herein.

FIG. 5A is an example paytable for a wagering Solitaire game disclosed herein, and particularly for multiple related plays of the wagering Solitaire game.

DETAILED DESCRIPTION

The present disclosure may be implemented in various configurations for gaming systems or gaming devices, including but not limited to: (1) a dedicated gaming device, wherein the computerized instructions for controlling any games (which are provided by the gaming device) are provided with the gaming device prior to delivery to a gaming establishment; and (2) a changeable gaming device, where the computerized instructions for controlling any games (which are provided by the gaming device) are downloadable to the gaming device through a data network when the gaming device is in a gaming establishment. In one embodiment, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
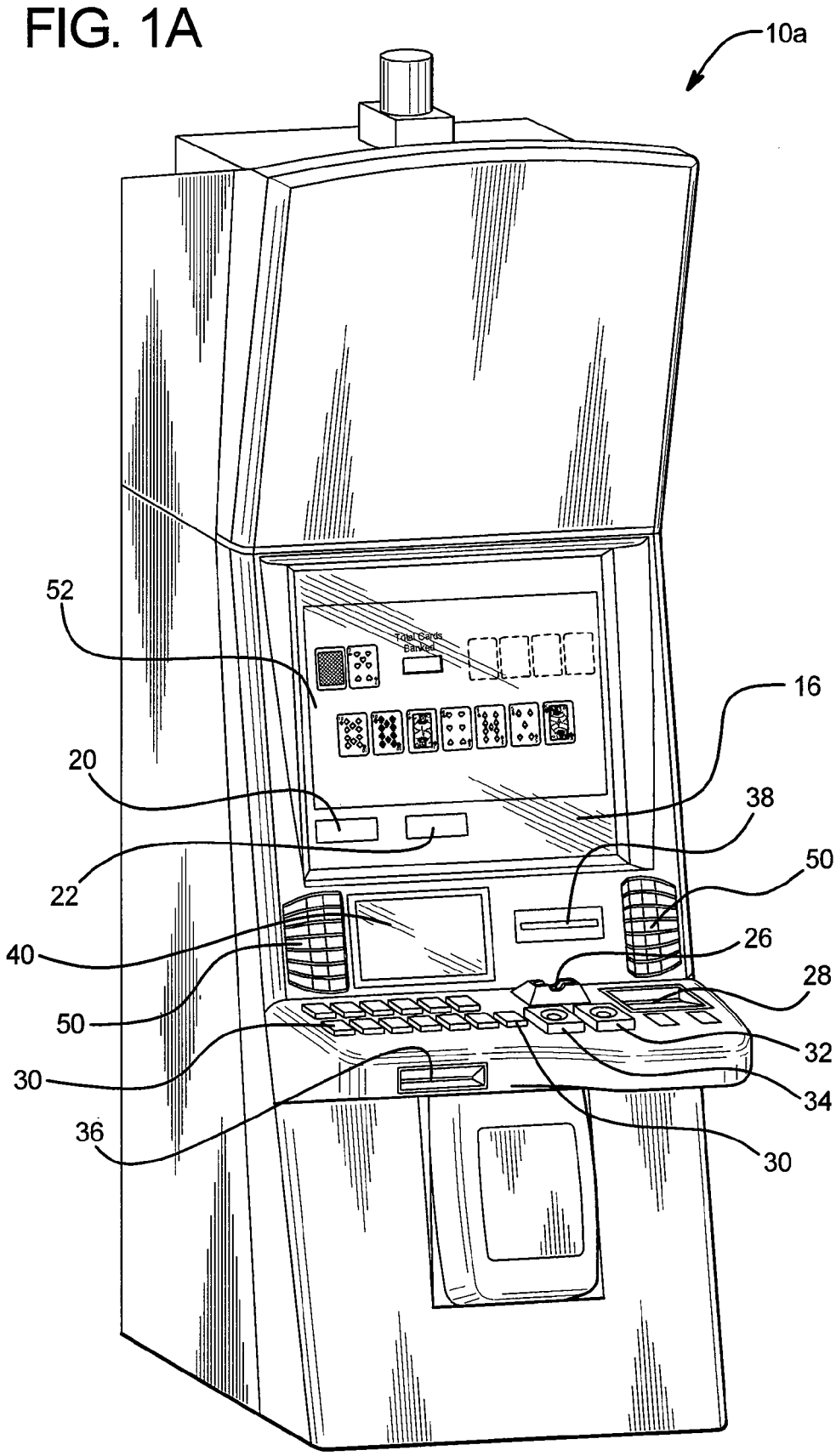
FIGS. 1A and 1B are front perspective views of alternative embodiments of gaming devices disclosed herein.
Figure 1B:
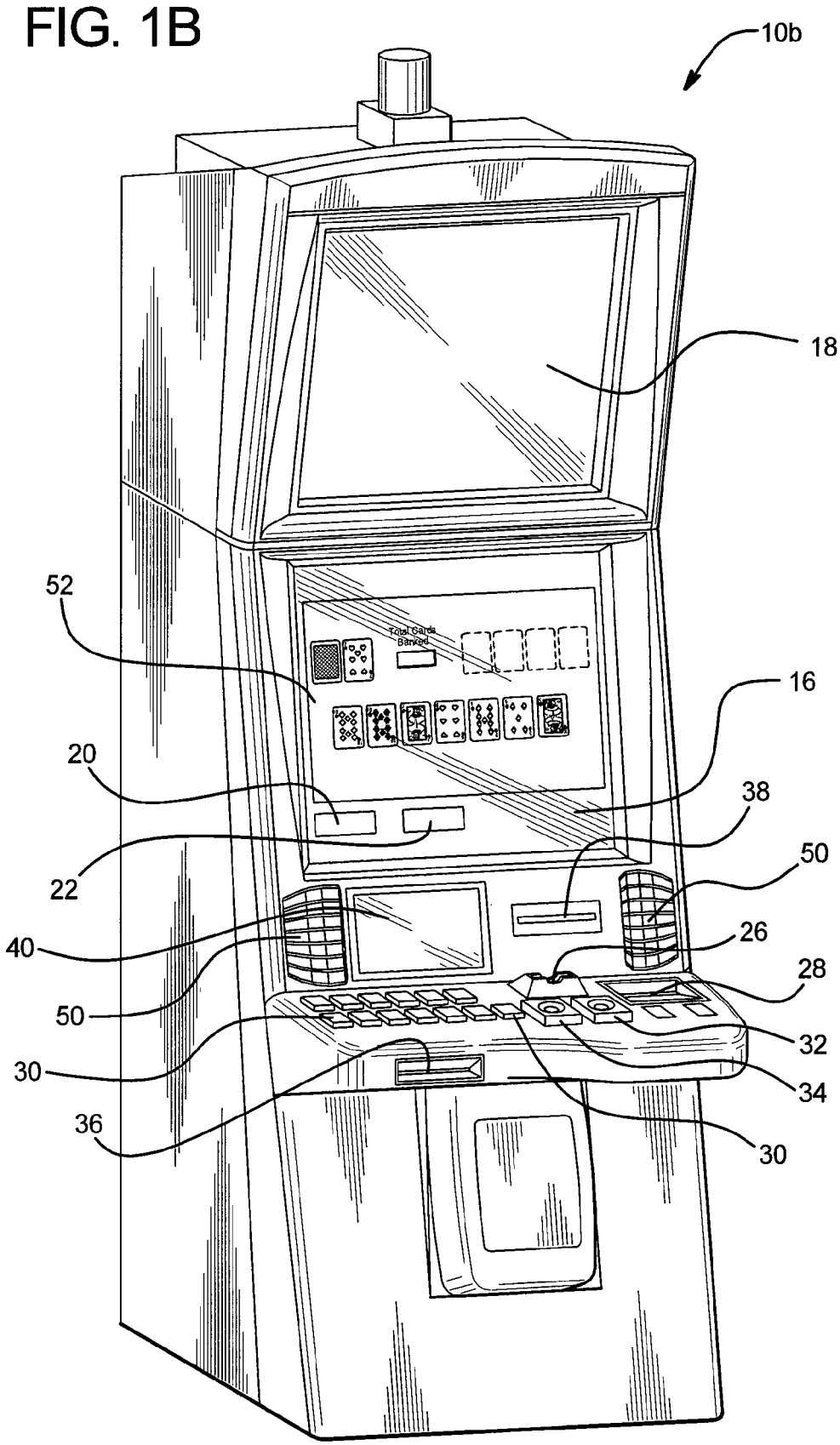

Referring now to the drawings, two example alternative embodiments of an example gaming device for providing the present disclosure are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
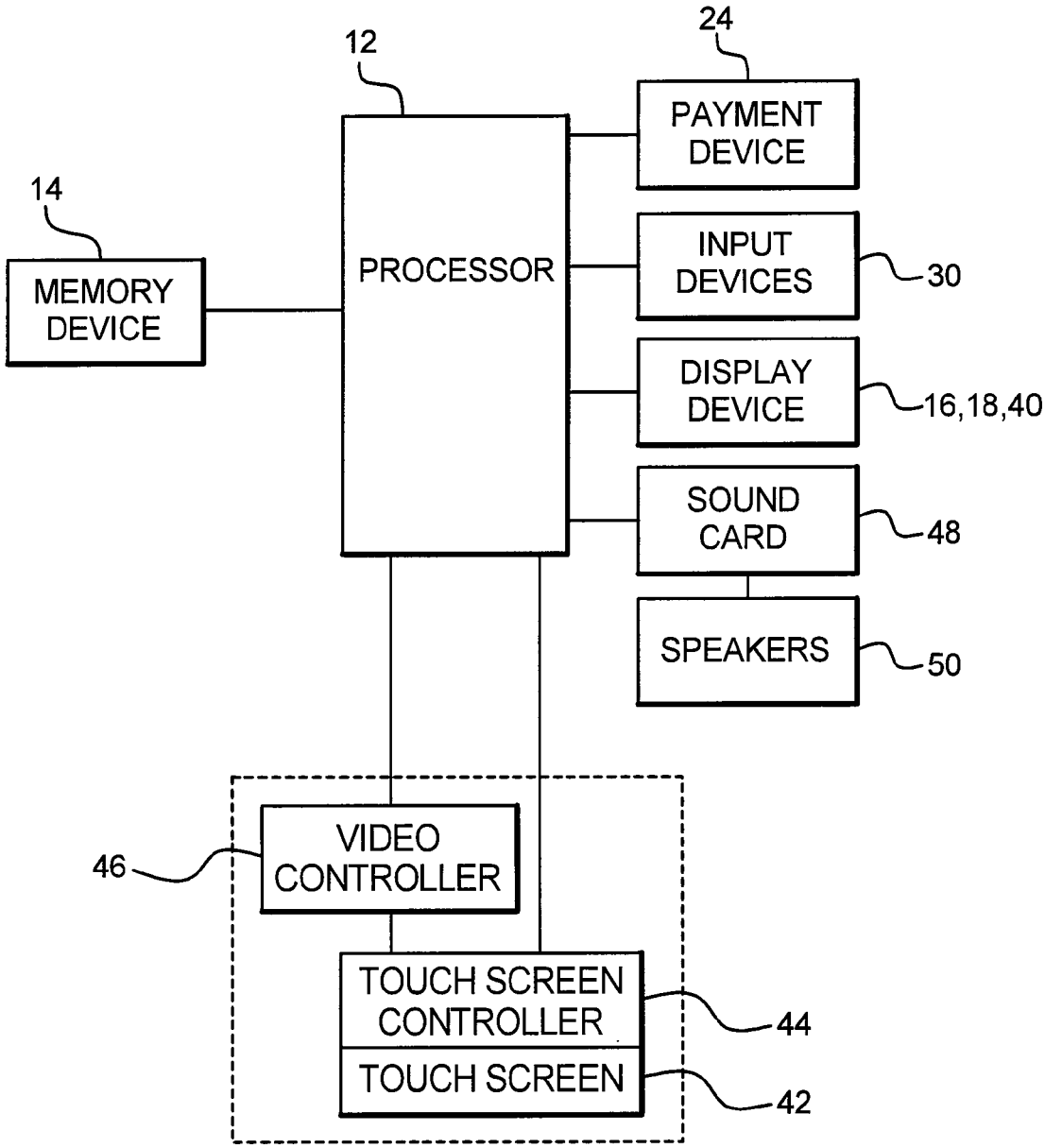
FIG. 2A is a schematic block diagram of the electronic configuration of one embodiment of a gaming device disclosed herein.

In one embodiment, as illustrated in FIG. 2A, the gaming device includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilizaton of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In one embodiment, as illustrated in FIG. 2A, the gaming device includes one or more display devices controlled by the processor. The display devices are connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered. In one embodiment, as described in more detail below, the gaming device includes a player tracking display 40 which displays information regarding a player's playing tracking status.

In other embodiments, the at least one display device is a mobile display device, such as a PDA or tablet PC, that enables play of at least a portion of the primary or secondary game at a location remote from the gaming device. The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices are of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a players identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown)

which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card may be implemented in accordance with the gaming device disclosed herein.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

After either adding a related symbol to the first string of related symbols or marking the first string of related symbols as complete, the gaming device proceeds as described above for each of the remaining classified strings of related symbols which were previously classified or formed from related symbols on the first and second reels.

In one embodiment, in addition to winning credits or other awards in a base or primary game, such as solitaire, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
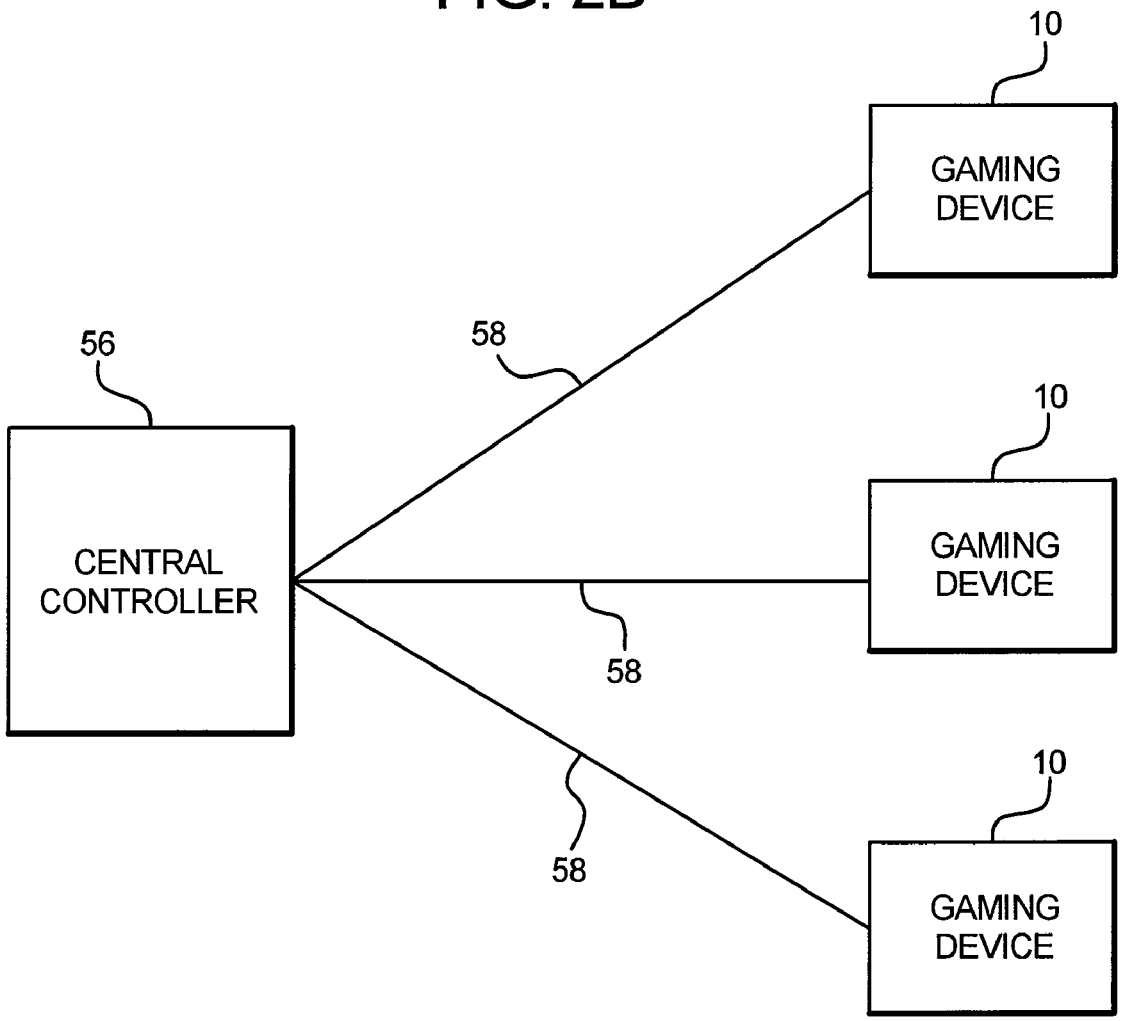
FIG. 2B is a schematic diagram of the central controller in communication with a plurality of gaming devices in accordance with one embodiment of the gaming system disclosed herein.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. Central production or control can assist a gaming establishment or other entity in maintaining appropriate records, controlling gaming, reducing and preventing cheating or electronic or other errors, reducing or eliminating win-loss volatility and the like.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any players gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts and/or the time these wagers are placed. In different embodiments, for one or more players, the player tracking system includes the players account number, the player's card number, the players first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Wagering Solitaire Game

The present disclosure provides one or more methods of determining suitable paytables for wagering Solitaire type games such as Klondike Solitaire and other similar type games and a gaming system, gaming device and method for providing such wagering games.

In one embodiment, an optimizer is used to determine each of the outcome probabilities associated with a designated Klondike Solitaire game. The optimizer simulates a designated number of plays of a designated Klondike Solitaire or similar type game according to: (a) specific designated rules for that game (such as those discussed above and below); and (b) designated strategies of play for that game.

Klondike Solitaire and similar games are associated with sets of game rules which govern moves or at least one placement of the cards, such as those described above. The optimizer simulates the designated number of plays of the designated Klondike Solitaire game according to the designated set of these rules. It should be appreciated that in different versions of Klondike Solitaire and solitaire generally, certain of these rules may vary. In one example, the designated rules input into the optimizer include the rules governing movement of the cards (such as those discussed above), wherein cards from the stock pile are turned face up one at a time and a player is allowed to go through the stock pile one time.

Klondike Solitaire may be played with various different play strategies. The play strategies include optimal methods of play within the confines of the governing rules. Many Klondike Solitaire play strategies are known. Other play strategies may be determined by statistically analyzing a sample pool of player game play decisions or by other suitable methods. These play strategies include both: (a) strategies applicable to the movement of cards within the field or from the field to the banks, sometimes referred to as "field move strategies;" and (b) strategies applicable to movement of the cards from the stock pile or discard pile to the field, sometimes referred to as "discard pile move strategies."

Examples of known Klondike Solitaire play strategies which may be input into the optimizer include: (a) always immediately playing an ace or deuce wherever one can; (b) always making the play or transfer that frees (or allows a play that frees) a face-down card, regardless of any other considerations; (c) when faced with a choice, always making the play or transfer that frees (or allows a play that frees) the downcard from the biggest pile of face-down cards; (d) transferring cards from pile to pile only to allow a face-down card to be freed; (e) not clearing a position a pile may occupy unless there is a king immediately waiting to occupy that position; (f) only playing a king that will benefit the pile with the biggest pile of face-down cards, unless the play of another king will at least allow a transfer that frees a face-down card; (g) only banking cards other than an ace or deuce when there is a spot on the board for the next lowest card below the potential bank card; (h) not playing or transferring a 5, 6, 7 or 8 anywhere unless at least it's next highest even/odd partner is in the column, it will allow a play or transfer that will immediately free a face-down card, there have not been any other cards already played to the column (it will be the second card from the top of the column) or there is no other choice; and (i) when all necessary cards are covered, immediately place any remaining free cards in their appropriate banks. It should be appreciated that other suitable strategies may be employed.

Figure 3:
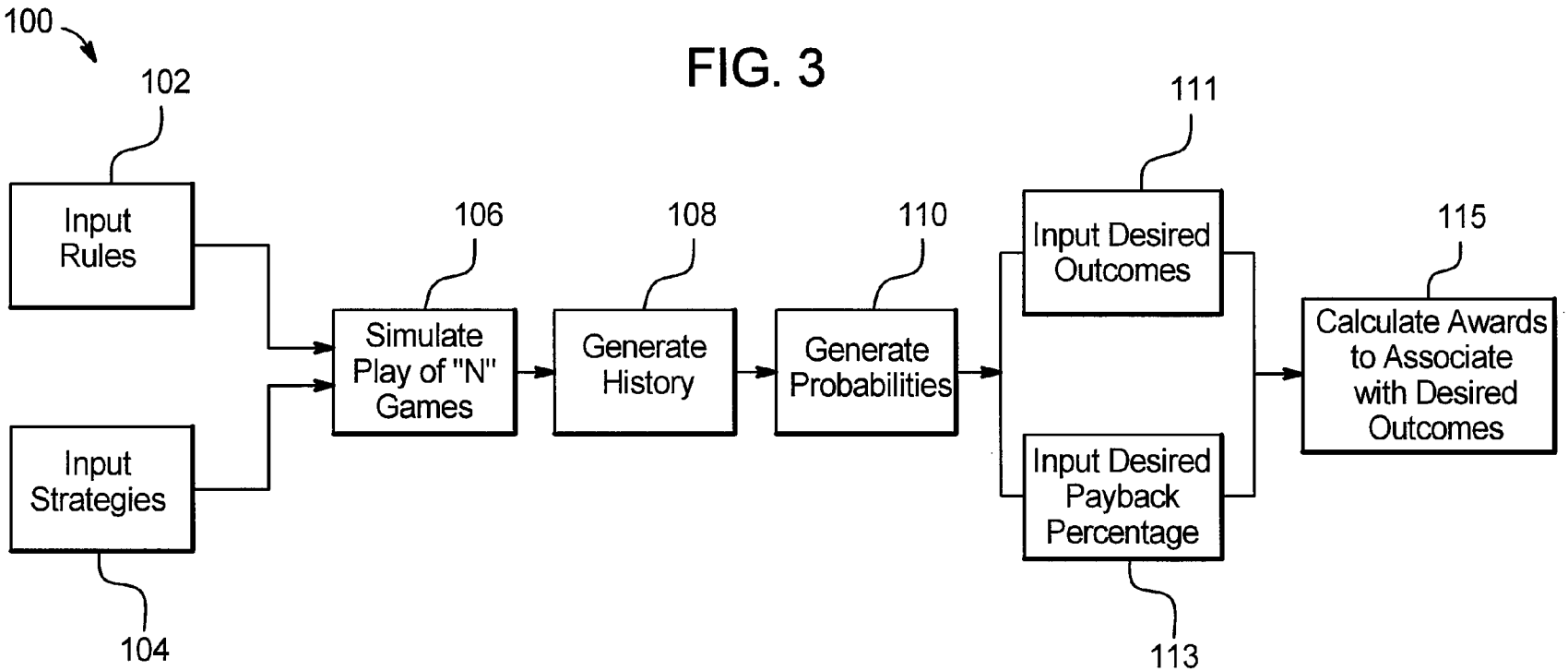
FIG. 3 is a flowchart of an embodiment of an optimizer disclosed herein.

Referring now to FIG. 3, designated rules and strategies are input into the optimizer 100, as illustrated by boxes 102 and 104. The optimizer 100 simulates play of "N" games, as illustrated by box 106. It should be appreciated that the optimizer 100 may be configured to play any suitable number of games (i.e., 10,000, 100,000, 1,000,000, etc.). As the optimizer is simulating the play of Klondike Solitaire games, the optimizer generates a history as illustrated by box 108. The history includes statistics associated with the plays of the designated Klondike Solitaire game. In certain embodiments, the history includes statistics associated with: (a) the number of games played; (b) the number of games solved; (c) the total number of cards banked per game; (d) the total number of cards banked in each respective bank per game; (e) the total number of moves or placements made during the play of each game; and (f) any other suitable data. An example of such a history 118 is illustrated in FIG. 4.

Referring again to FIG. 3, in one embodiment, the optimizer 100 generates suitable probabilities (i.e., within acceptable tolerances) associated with the statistics generated by the optimizer, as illustrated by box 110. These probabilities are associated with the various Klondike Solitaire game outcomes which result from plays of the designated Klondike Solitaire game based on the rules or set of rules and strategies input for that game. It should be appreciated that in other embodiments, the optimizer need not calculate these probabilities, as these probabilities may be calculated by other methods using the optimizer history. In one embodiment, the optimizer uses a Monte Carlo approach. This approach takes a large number of random samples, such as in this case a large number of simulated games and tracks performance statistics. For example, the optimizer may run 1 million games. In this simulation, if 22,000 games resulted in a completely solved game (according to the inputted rules); then, the optimizer can provide that 22,000 in 1,000,000 (or 1 in 45 games) are solvable, on average. Using this information and the other play information, the optimizer enables the gaming device designer to create a suitable paytable which takes into account each possible outcome. In other words, the designer determines each outcome they want in their paytable and the optimizer is used to determine the approximate probability for each such outcome.

Paytables utilized by gaming devices are typically constructed to achieve a designated average expected payback percentage. A paytable's average expected payback percentage is a function of the respective probabilities (within limited tolerances) of achieving each and every outcome in the paytable and the respective awards associated with those outcomes. Thus, using such calculated probabilities (within limited tolerances) for designated outcomes, appropriate awards to associate with each respective outcome such that a paytable achieves a desired average expected payback percentage may be calculated. It should be appreciated that the probabilities (within limited tolerances) associated with various game outcomes vary according to the designated game rules and strategies utilized by the optimizer 100. Accordingly, the strategies input into the optimizer 100 may be varied and the awards in any resulting paytable may be adjusted in response to varying resulting probabilities (within limited tolerances). It should also be appreciated that the strategies utilized by the optimizer 100 may or may not reflect actual play of a player during a play of the game. Specifically, referring again to FIG. 3, once outcomes to be placed in a paytable are determined, along with a desired payback percentage, as illustrated in boxes 111 and 113, awards associated with these outcomes may be calculated as illustrated in box 115.

Figure 6:
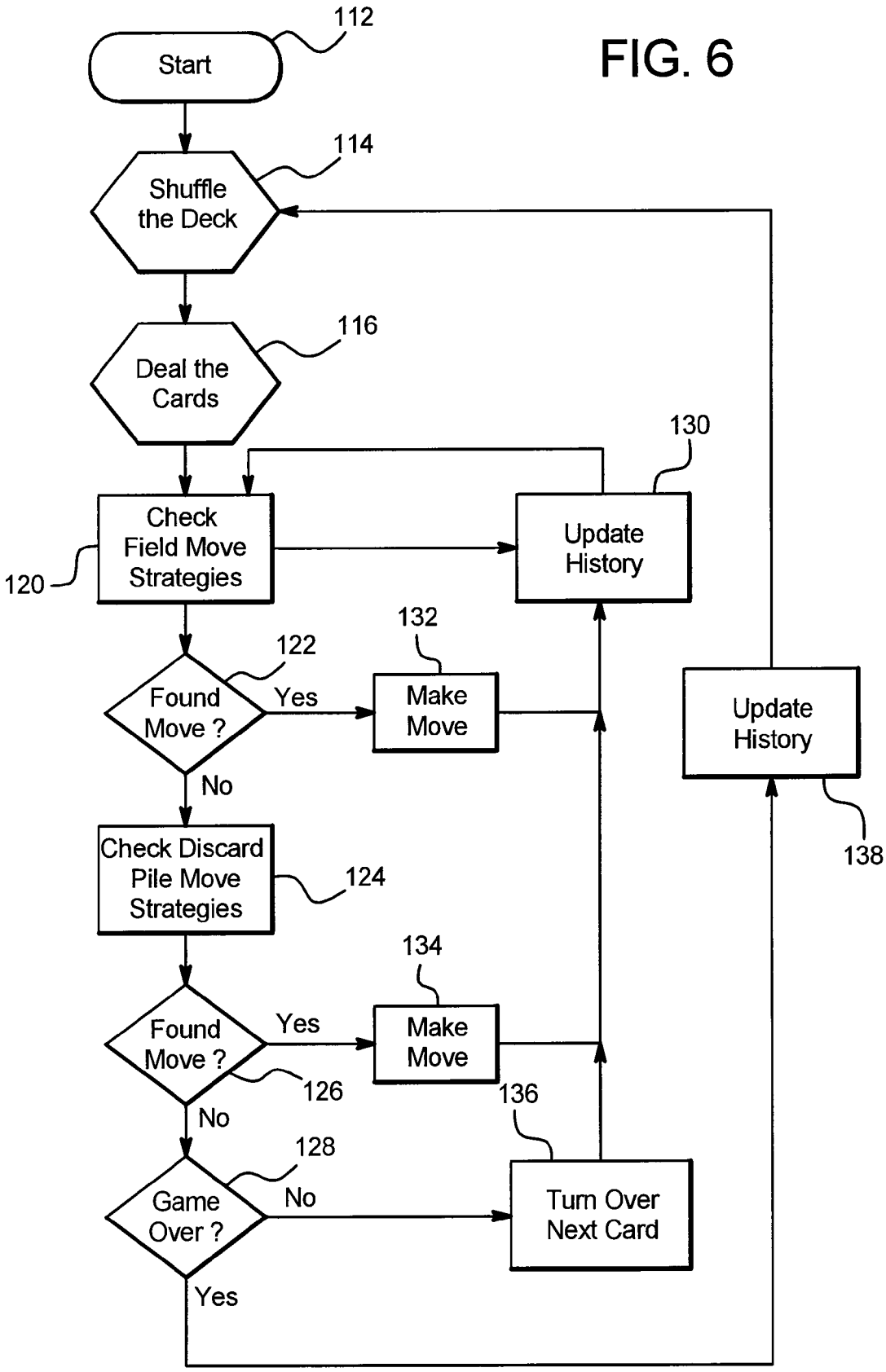
FIG. 6 is a flowchart of an embodiment of the optimizer disclosed herein.

FIG. 6 illustrates a more detailed flowchart of the steps taken by the optimizer 100. The optimizer 100 begins by shuffling the deck and dealing the cards, as illustrated by 112, 114 and 116. The optimizer 100 checks the field move strategies to determine if a move consistent with the field move strategies is available, as illustrated in box 120. If the optimizer 100 finds a field move, the optimizer 100 makes the move, updates the history and checks the field move strategies for another move, as illustrated in 120, 122, 132 and 130.

If the optimizer 100 does not find a move consistent with the field move strategies 120, the optimizer checks the discard pile move strategies to determine if a move consistent with the discard pile move strategies is available, as illustrated in 124. If the optimizer 100 finds a discard pile move, the optimizer 100 makes the move, updates the history and again checks the field move strategies for a move, as illustrated by 126, 134, 130 and 120.

If the optimizer 100 finds neither a field move nor a discard pile move, the optimizer determines if the play of the game is over, as illustrated in 128. For purposes of the optimizer 100, the game is over if: (a) no cards remain in the stock pile and no field moves or placements are available; or (b) all 52 cards of the deck are banked. If the game is not over, the optimizer 100 turns over the next card in the stock pile, updates the history and again checks for field move strategies, as illustrated by 128, 136, 130 and 120.

If the optimizer 100 determines that a play of the game is over, the optimizer 100 updates the history and shuffles the deck, beginning simulated play of another game (if any), as illustrated by 128, 138 and 114.

The optimizer 100 continues to simulate play of Klondike Solitaire games until the optimizer 100 is stopped. It should be appreciated that in various embodiments, the optimizer stops upon the occurrence of any one of: (a) the passage of a predetermined or randomly determined amount of time; (b) the manual stopping of the optimizer by a user; (c) the simulated play of a predetermined or randomly determined number of games; or (d) any other suitable event.

It should be appreciated that the optimizer may determine that a variety of field moves or placements or discard pile moves or placements are available during a play of a Klondike Solitaire game. In certain embodiments, the strategies input into the optimizer are arranged in a hierarchy, such that certain moves or at least one placement are made before others if multiple moves or placements are available. In other embodiments, which move the optimizer selects from any available moves may be randomly determined.

In various embodiments, after the probabilities associated with desired Klondike Solitaire outcomes or events have been determined, awards are associated with those outcomes or events, and ultimately, a paytable is created which achieves a designated average expected payback percentage (as discussed above).

In various embodiments, the Klondike Solitaire or similar type game outcomes or events associated with awards in a created paytable could include any of: (a) the placement of a designated number of cards in a certain bank, also sometimes referred to as "payout zone" (i.e., five cards in the hearts payout zone); (b) the placement of a designated range of numbers of cards in a certain payout zone (i.e., five to ten cards in the clubs payout zone); (c) the placement of a total designated number of cards in the payout zones, collectively (i.e., one card in each of the hearts, diamonds, spades and clubs payout zones); (d) the placement of a designated range of numbers of cards in the payout zones, collectively (i.e., five to nine cards total in the hearts, diamonds, spades and dubs payout zones); and (e) any other suitable outcome or event.

One example paytable for a wagering Klondike Solitaire game having an average expected payback percentage of about 97 percent is illustrated in FIG. 5A and generally indicated by numeral 90. This example paytable 90 includes example Klondike Solitaire game outcomes and respective awards associated with those outcomes for three stages of play or three plays of the game, as illustrated in FIG. 5A.

The paytable 90 includes outcomes including different ranges of the total number of cards which are banked, or placed in the payout zones, at the time a stage of play of the game terminates. The size of certain ranges are also different. In various embodiments of the paytable, the ratio of at least one award to a respective: (a) number of cards banked; (b) lowest number of cards in a range of numbers of cards banked; (c) highest number of cards in a range of numbers of cards banked; and (d) total number of cards in a range of numbers of cards banked is different than the ratio of another different award in the paytable to such respective values.

In one embodiment the ratio of the lowest number of cards in a range of numbers of cards banked to one award is different than that of at least one different award to a respective lowest number of cards in a range of numbers of cards banked. For example, referring now specifically to the paytable 90 in FIG. 5A and Table 1 below, the ratio (35/7=5) for a first stage award of 35 credits associated with the lowest number of cards, 5, in a range of 5 to 9 cards being banked is different than the ratio (400/25=16) for a first stage award of 400 credits associated with the lowest number of cards, 25, in a range of 25 to 29 cards being banked.

TABLE 1

| First Stage (Award/ Lowest Number in Range of Cards) | Second Stage (Award/Lowest Number in Range of Cards) | Third Stage (Award/ Lowest Number in Range of Cards) |
|---|---|---|
| (35/5) = 7 | (175/5) = 35 | (700/5) = 140 |
| (50/10) = 5 | (250/10) = 25 | (1000/10) = 100 |
| (100/15) = 6.67 | (500/15) = 33.33 | (2000/15) = 133.33 |
| (200/20) = 10 | (1000/20) = 50 | (4000/20) = 200 |
| (400/25) = 16 | (2000/25) = 80 | (8000/25) = 320 |
| (750/30) = 25 | (3750/30) = 125 | (15000/30) = 500 |
| (1000/35) = 28.57 | (5000/35) = 142.86 | (20000/35) = 571.43 |
| (2000/50) = 40 | (10000/50) = 200 | (500000/50) = 10,000 |

Similarly, in one embodiment, the ratio of the upper number of cards in a range of numbers of cards banked to one award is different than that of at least one different award to a respective upper number of cards in a range of numbers of cards banked. For example, referring now specifically to the paytable 90 in FIG. 5A and Table 2 below, the ratio (35/9=3.89) for a first stage award of 35 credits associated with the upper number of cards, 9, in a range of 5 to 9 cards being banked is different than the ratio (400/29=13.79) for a first stage award of 400 credits associated with the upper number of cards, 29, in a range of 25 to 29 cards being banked.

TABLE 2

| First Stage (Award/Upper Number in Range of Cards) | Second Stage (Award/Upper Number in Range of Cards) | Third Stage (Award/Upper Number in Range of Cards) |
|---|---|---|
| (35/9) = 3.89 | (175/9) = 19.44 | (700/9) = 77.78 |
| (50/14) = 3.57 | (250/14) = 17.86 | (1000/14) = 71.43 |
| (100/19) = 5.26 | (500/19) = 26.32 | (2000/19) = 105.26 |
| (200/24) = 8.33 | (1000/24) = 41.67 | (4000/24) = 166.67 |
| (400/29) = 13.79 | (2000/29) = 68.97 | (8000/29) = 275.86 |
| (750/34) = 22.06 | (3750/34) = 110.29 | (15000/34) = 441.18 |
| (1000/49) = 20.41 | (5000/49) = 102.04 | (20000/49) = 408.16 |
| (2000/52) = 38.46 | (10000/52) = 192.31 | (500000/52) = 9615.38 |

Figure 5B:
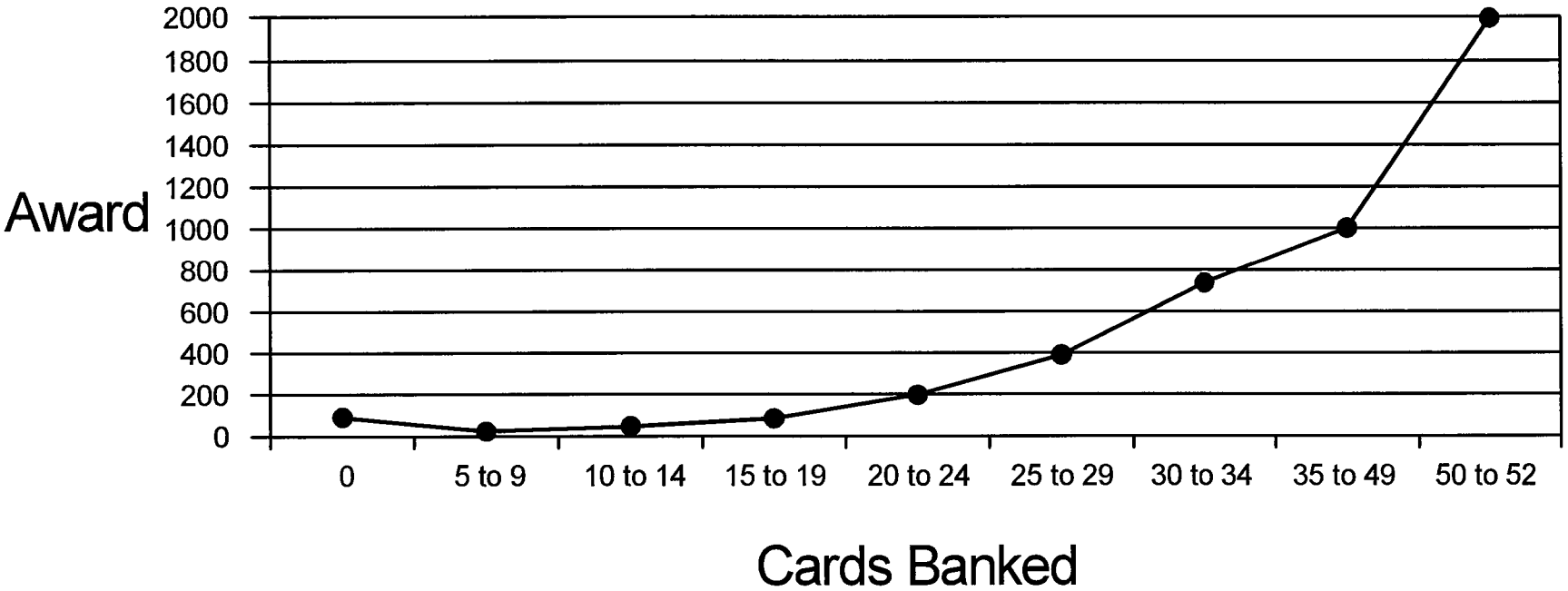
FIG. 5B is a graphical illustration of the relationship between certain outcomes and awards from the example paytable illustrated in FIG. 5A.

In the paytable 90 of FIG. 5A, the awards for each of the stages of play or plays of the solitaire game are at least in part non-linearly related to their respective ranges of numbers of cards. For example, in all three stages of play, the award associated with the range of 20 to 24 cards banked is twice that associated with the range of 15 to 19 cards banked, as illustrated in FIG. 5A. However, for example, in all three stages of play, the award associated with the range of 35 to 49 cards banked is five times that associated with the range of 20 to 24 cards banked. This non-linear relationship is more specifically illustrated by FIG. 5B, which graphically depicts the relationship between certain ranges of the total number of cards banked and their respective awards for the first stage of play for the example paytable illustrated in FIG. 5A. As FIG. 5B depicts, some award progressions are linearly related (i.e., the awards extending from the range of 10 to 14 cards banked to the range of 15 to 19 cards banked), while others are not (i.e., the awards extending from the range of 25 to 29 cards banked to the range of 50 to 52 cards banked).

Also, in various embodiments, certain awards in the paytable have a different ratio to the total number of cards in their respective range of numbers of cards banked than other different awards in the paytable. For example, referring to FIG. 5A and Table 3 below, the ranges of number of cards banked include anywhere from 0 to 15 cards banked. For example, in the first stage of play, the ratio (35/5=7) for an award of 35 credits associated with the range of 5 to 9 cards banked in the first stage of play is different than the ratio of (1000/15=66.68) for an award of 1000 credits associated with the range of 35 to 49 cards banked.

TABLE 3

| First Stage (Award/Total Cards in Range) | Second Stage (Award/Total Cards in Range) | Third Stage (Award/Total Cards in Range) |
|---|---|---|
| (35/5) = 7 | (175/5) = 35 | (700/5) = 140 |
| (50/5) = 10 | (250/5) = 50 | (1000/5) = 200 |
| (100/5) = 20 | (500/5) = 100 | (2000/5) = 400 |
| (200/5) = 40 | (1000/5) = 200 | (4000/5) = 800 |
| (400/5) = 80 | (2000/5) = 400 | (8000/5) = 1600 |
| (750/5) = 150 | (3750/5) = 750 | (15000/5) = 3000 |
| (1000/15) = 66.68 | (5000/15) = 333.33 | (20000/15) = 1,333.33 |
| (2000/3) = 666.67 | (10000/3) = 3,333.33 | (500000/3) = 166,666.67 |

It should be appreciated that in other embodiments, such as for other sets of rules, awards associated with designated numbers of cards or ranges of numbers of cards the payout zones can be different, and in particular can have alternate relationships to their respective number of cards or range of numbers of cards. It should also be appreciated that the size of any ranges of numbers of cards associated with various awards need not be equal. For example, the paytable 90 includes ranges of the total number of cards in the deck spanning up to 15 cards, as illustrated in FIG. 5A. In certain other embodiments, the number of cards in each range are equal.

The awards in a paytable created using an optimizer such as that discussed above could include both primary awards and bonus awards. In various embodiments using such a paytable, a player could receive bonus awards associated with any of a variety of Klondike Solitaire or similar type game outcomes or events. The Klondike Solitaire game outcomes or events associated with bonus awards may include any of: (a) the placement of a designated card or cards in a payout zone or the payout zones, collectively (i.e., the placement of an eight of hearts in the hearts payout zone or bank); (b) the non-placement of or inability to place a certain card or cards in a payout zone or the payout zones, collectively, during a play of the game (i.e., the unavailability of aces during a play of the game); (c) the placement of at least a designated number of cards in each of the payout zones (i.e., one card in each payout zone or bank); (d) the placement of at least a designated number of cards in a certain payout zone or bank; (e) the "filling" of one or more payout zones (i.e., placement of thirteen cards in the diamonds payout zone or bank); (f) the completion of a designated consecutive number of moves or placements (i.e., four manual moves); (g) the completion of play within a certain period (i.e., a designated amount of time); and (h) any other suitable outcome or event.

The present disclosure also contemplates that a bonus game or opportunity to win a bonus award can be employed in place of one of the payouts. In one such example, the average expected payout of the bonus game is the same as the replaced payout. This bonus game may be any suitable bonus game.

For example, the example paytable 90 includes an award associated with zero cards banked in the payout zones, as illustrated in FIG. 5A. This award could be considered a primary award or a bonus award. It should be appreciated that in various embodiments, primary awards and bonus awards may be in the same paytable or different paytables.

The present disclosure also includes a gaming device for providing a wagering Klondike Solitaire or similar type game. In various embodiments, the Klondike Solitaire game includes one stage or multiple stages. In one embodiment disclosed herein, the game includes multiple stages. In this embodiment, if the player wins, completes or solves the Klondike Solitaire game, the player advances to a next stage of play, wherein the player is dealt a new Klondike Solitaire game. In this embodiment, the player continues to advance in such a manner upon winning each respective stage until no further stages remain. It should be appreciated that in other embodiments, a player may advance to subsequent stages independent of the result of previous stages based on other designated game events or upon an additional wager.

The present disclosure provides a paytable 90 illustrated in FIG. 5A for a Klondike Solitaire game including three stages of play. It should be appreciated that the paytable 90 includes awards associated with various ranges of numbers of cards banked for three respective stages of play. In the paytable 90, the awards are modified by a multiplier in the second and third stages of game play, as illustrated in FIG. 5A. Specifically, in the second stage, each of the awards are multiplied by five. In the third stage, each of the awards are multiplied by twenty, with the exception of the award associated with the range of 50 to 52 cards banked, which is an enhanced award of 500,000 credits. Although each of the awards in the second and third stages are associated with multipliers, providing an enhanced award above and beyond what the multiplier for the third stage would provide creates enhanced excitement for the player and an enhanced incentive to solve or complete three consecutive plays of the solitaire game.

Providing three stages of play provides more than just enhanced excitement for the player. It is somewhat known that people solve or complete a Klondike Solitaire game about one in forty-five plays. Thus, a problem facing the inventors in making Klondike Solitaire a casino game was that a relatively big award could not be associated with solving the game because it happens too often. Based on the estimate of one solve of a Klondike Solitaire game per forty-five plays, the probability of a player solving three consecutive games would be approximately one in 91,125 plays [(1/45)*(1/45)*(1/45)]. This lower probability, which is accomplished by enabling the player to play, in this example, three consecutive games, allows a relatively much larger award to be associated with solving the game in a third stage of play. This approximate analysis is based on an embodiment in which the player wins, completes or solves the game to advance to the next stage of play. It should be appreciated that in other embodiments in which the player need not win, complete or solve the game to advance to a next stage of play, the same general methodology applies, but with different probabilities, depending on the criteria set for player advancement.

It should be appreciated that in various other embodiments, the player is not automatically entitled an enhanced award for winning, completing or solving the game in the third stage of play. In one embodiment, the player is entitled to such an enhanced award in the third stage of play if the player places an additional wager upon initiation of the plays of the game or wagers a designated amount.

An example of such an embodiment is illustrated in FIGS. 7A to 8C. A player places a wager of 100 credits on the Klondike Solitaire game, as illustrated in the Bet Display 20 of FIG. 7A. It should be appreciated that although in this and other embodiments herein, the player places a wager of 100 credits to play the Klondike Solitaire game, in various other embodiments, the player can wager varying amounts. The paytable 90 of FIG. 5A includes awards provided to the player per wager increment of 100 credits. Thus, if a player were to wager, for example, 200 credits, the player would receive twice the value of any award in the paytable 90.

In this embodiment, the wager of 100 credits entitles the player to a play or round of plays of Klondike Solitaire. It should be appreciated that in other embodiments, the wager includes: (a) a wager on a designated number of cards being placed in a certain payout zone or bank; (b) a wager on a designated number of cards being placed in the payout zones, collectively; (c) a wager on a designated range of numbers of cards being placed in a certain payout zone; (d) a wager on a designated range of numbers of cards being placed in the payout zones, collectively; (e) a wager on a designated number of cards being placed in a certain combination of payout zones or banks (i.e., diamonds and hearts); (f) a wager on a designated range of numbers of cards being placed in a certain combination of payout zones or banks (i.e., clubs and spades); (g) any combination of these; or (h) a wager on any other suitable outcome.

Figure 7A:
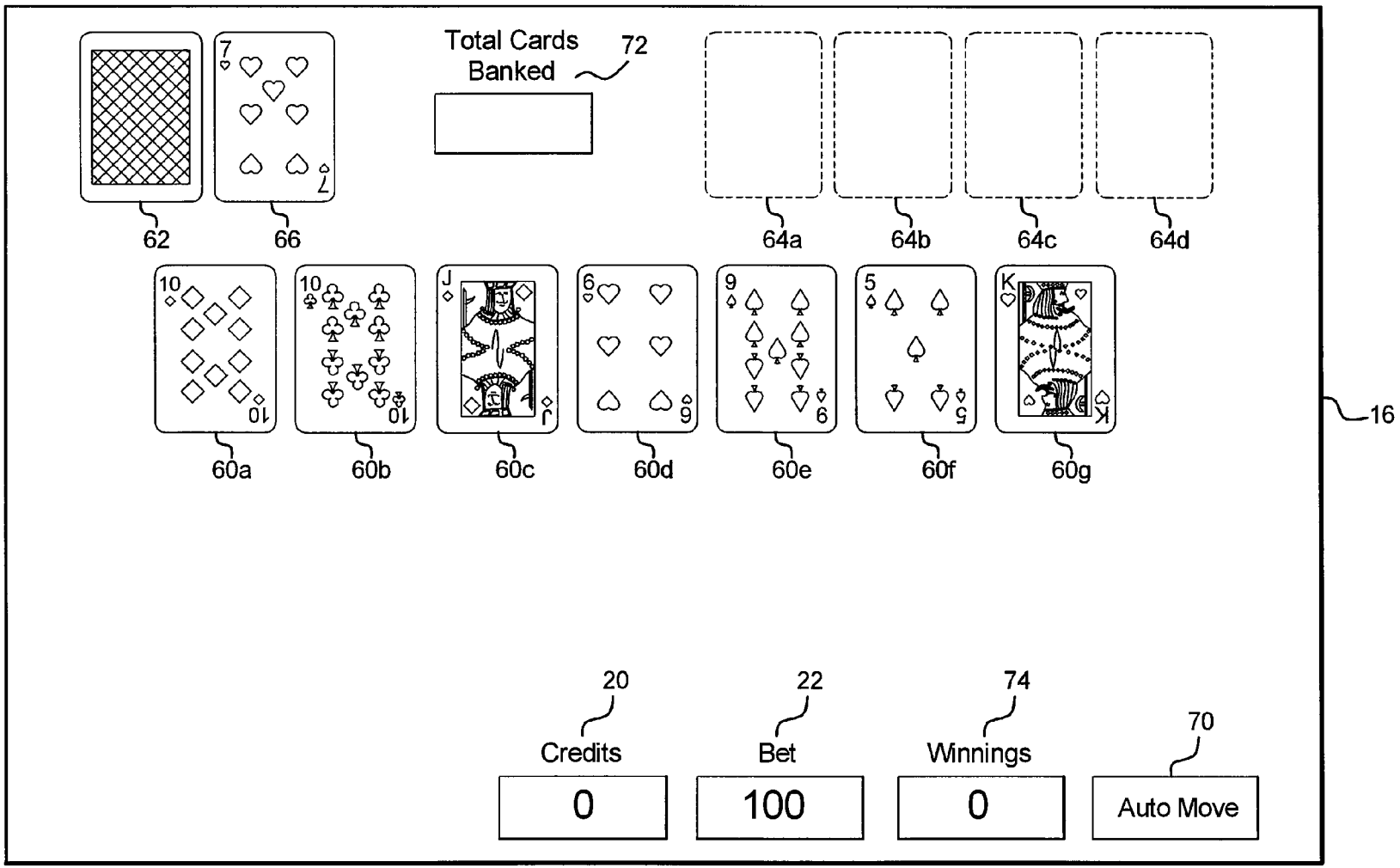
FIGS. 7A, 7B, 7C, 7D, 7E, 7F, 7G, 7H and 7I include front views of a gaming device display enabling the play of game in accordance with one embodiment of the gaming system, gaming device and method disclosed herein.

After the player places the wager, the gaming device 10*a* or 10*b* causes a game of Klondike Solitaire to be dealt and displayed on the display 16. In this embodiment, cards turned face up from the stock pile 62 are displayed one at a time in the discard pile 66, as illustrated in FIG. 7A. It should be appreciated that in other embodiments the stock cards may be displayed more than one at a time.

Each of the piles 60*a*, 60*b*, 60*c*, 60*d*, 60*e*, 60*f* and 60*g* include one card dealt face-up, as illustrated in FIG. 7A. Four banks, or payout zones, 64*a*, 64*b*, 64*c* and 64*d* are displayed above the piles. The Total Cards Banked display 72 displays the number of cards placed in the payout zones at any given point during a play of the game.

In various embodiments disclosed herein, the Klondike Solitaire game includes a manual mode, an automatic mode or a semi-automatic mode. In the manual mode, the player makes all Klondike Solitaire strategy decisions and causes the cards to move accordingly. In the automatic mode, the gaming device makes all of the moves or at least one placement for the player, wherein the gaming device determines what moves or placements to make for the player based on designated game strategy criteria. In one semi-automatic mode, the gaming device suggests or makes moves or at least one placement for the player if the player appears stuck or does not make a move within a designated period of time. In various embodiments, the gaming device also makes moves or at least one placement for the player which are guaranteed safe moves. Safe moves are moves which can only have a positive effect. Such moves may include, for instance, automatically banking an ace or a two, automatically banking any card of face value N when all cards of face value 1 to N−2 have been banked, automatically moving a King to an empty spot when there are sufficient empty spots for all Kings, and automatically drawing the next card when no other move is possible.

In various embodiments, the gaming device assists the player during play of the Klondike Solitaire game. The gaming device assists the player under a variety of circumstances. For example, the gaming device may assist the player if: (a) a designated period (such as an amount of time) has passed between moves; (b) only one move is available; (c) the game is in automatic mode; (d) a designated game event occurs; (d) any combination of these; or (e) under any suitable circumstances. In this embodiment the player places the game in automatic mode by selecting the Auto Move button 70, as illustrated in FIG. 7A. In this embodiment, the gaming device assists the player by making at least one move on behalf of the player when the player selects the Auto Move button 70.

In certain embodiments, the gaming device assists the player in a variety of ways. For example, in various embodiments, the gaming device assists the player by: (a) suggesting moves; (b) performing moves for the player (i.e., automatically placing aces and deuces in their respective banks when they are free); (c) pointing out missed potential moves; (d) allowing the player to undo one or more moves; (e) any combination of these; or (f) other suitable methods. In one embodiment, the gaming device enhances audio associated with the game or the brightness of the display to emphasize certain suggestions or in association with assistance to the player in any suitable capacity.

Figure 7B:
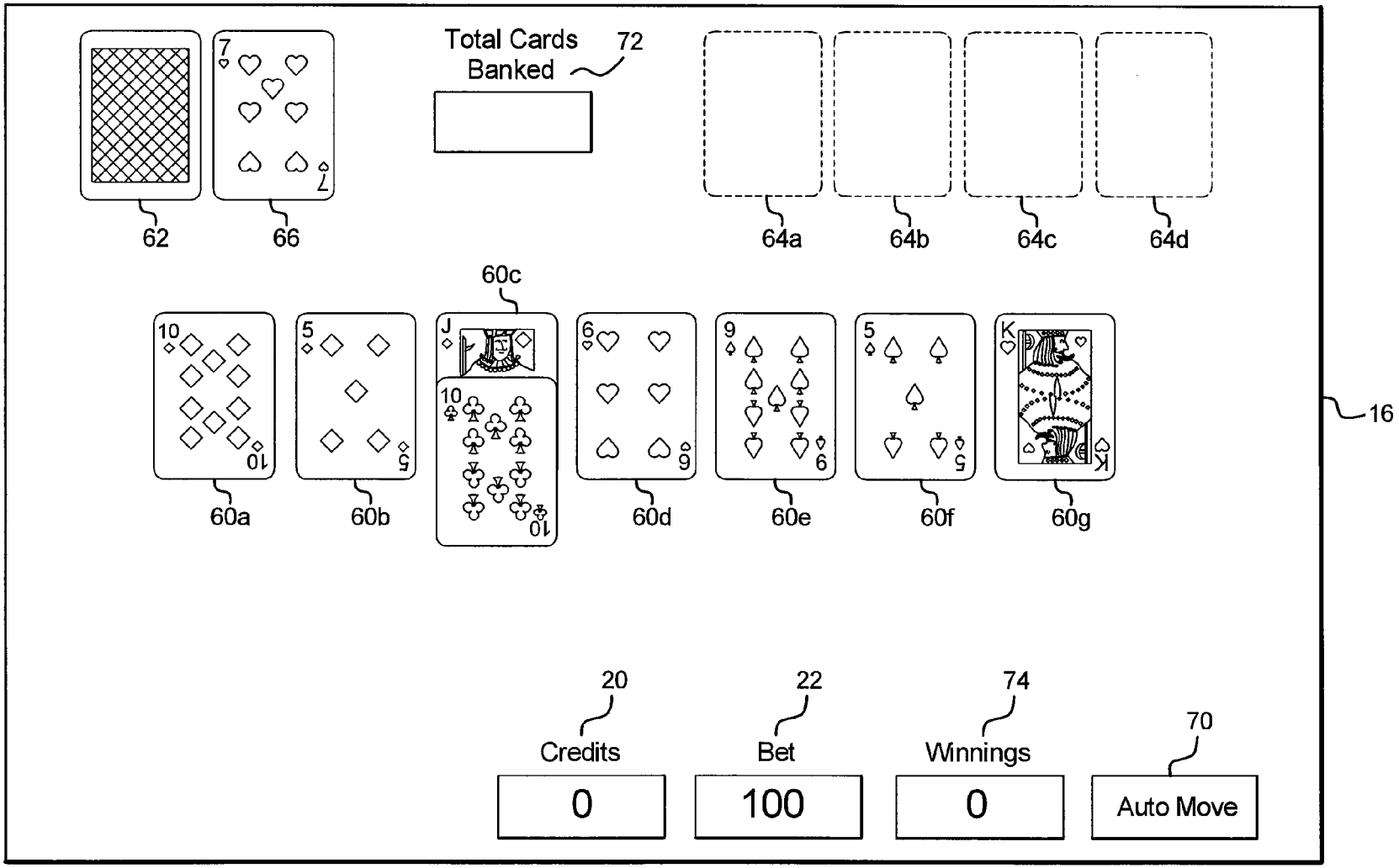

Turning now specifically to the series of figures beginning with FIG. 7A, the player makes their first move manually, building the ten of clubs from pile 60*b* onto the jack of diamonds on pile 60*c*, as illustrated in FIG. 7B. After the ten of clubs is moved from pile 60*b*, the next card in the pile 60*b*, the five of diamonds, is placed face-up on pile 60*b*, as illustrated in FIG. 7B.

Figure 7C:
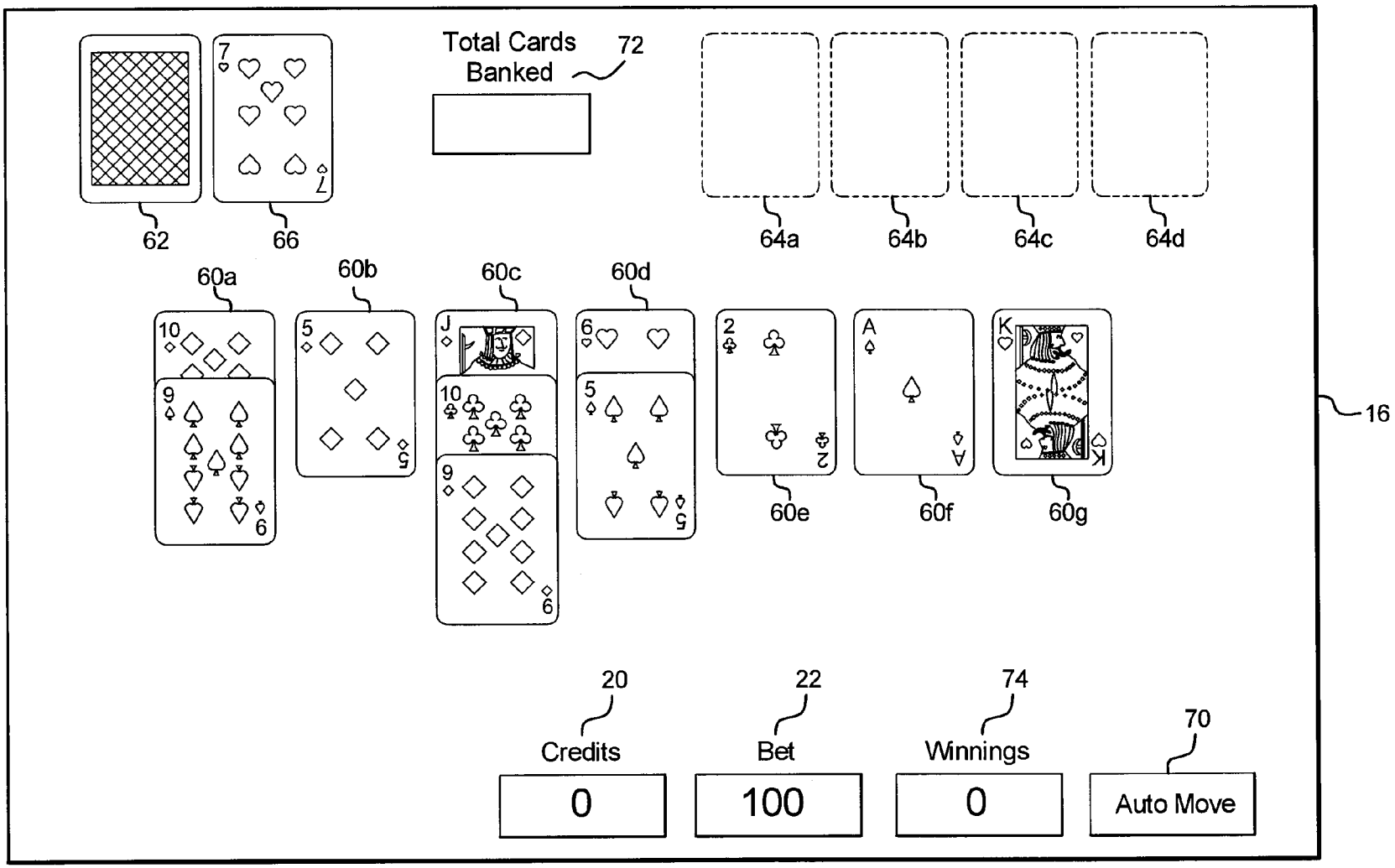

The player makes three further moves manually. The result of those moves is illustrated in FIG. 7C. The player builds the nine of spades from pile 60*e* onto the ten of diamonds on pile 60*a*. A nine of diamonds is then turned face-up on pile 60*e*. The player builds the nine of diamonds from pile 60*e* onto the ten of clubs on pile 60*c*. The player builds the five of spades from pile 60*f* onto the six of hearts on pile 60*d*. After doing so, an ace of spades is turned face up on pile 60*f*, as illustrated in FIG. 7C.

Figure 7D:
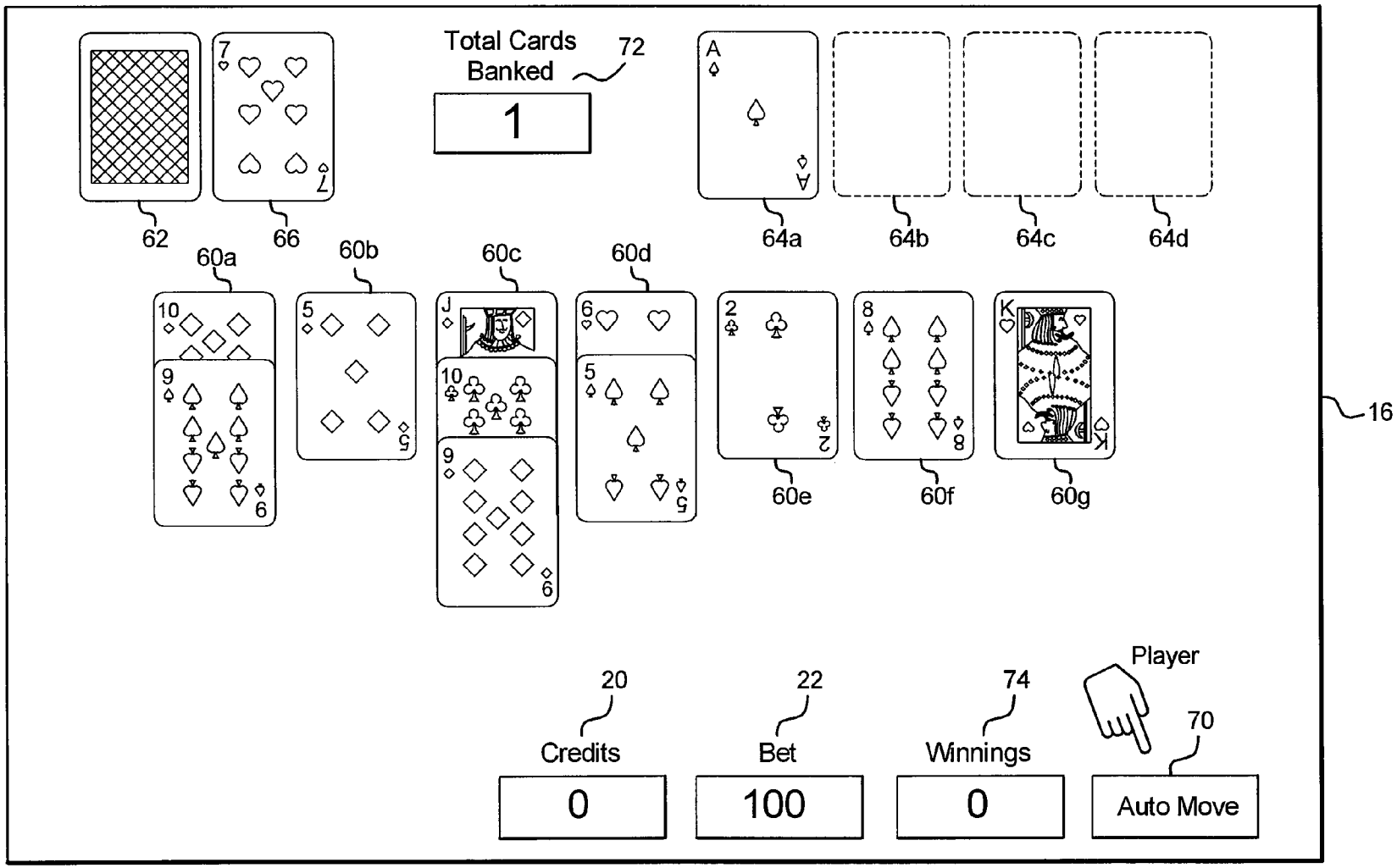

The player selects the Auto Move button 70 to have the gaming device make their fifth move, as illustrated in FIG. 7D. Now that the ace of spades is "free" (face-up on pile 60*f*, as illustrated in FIG. 7C), the ace of spades may be placed in its respective payout zone. Accordingly, the gaming device moves the ace of spades from pile 60*f* to payout zone 64*a*, as illustrated in FIG. 7D. It should be appreciated that in this embodiment, upon selection of the Auto Move button 70, the gaming device makes one move for the player. In other embodiments, selection of the Auto Move button 70 may cause the gaming device to make multiple moves for the player or play the entire game on behalf of the player. It should also be appreciated that in other embodiments, the gaming device automatically causes aces, deuces, and/or additional cards to be placed in their respective payout zones, absent any player intervention. The Total Cards Banked display 72 indicates that one card (the ace of spades) is banked, as illustrated in FIG. 7D.

Figure 7E:
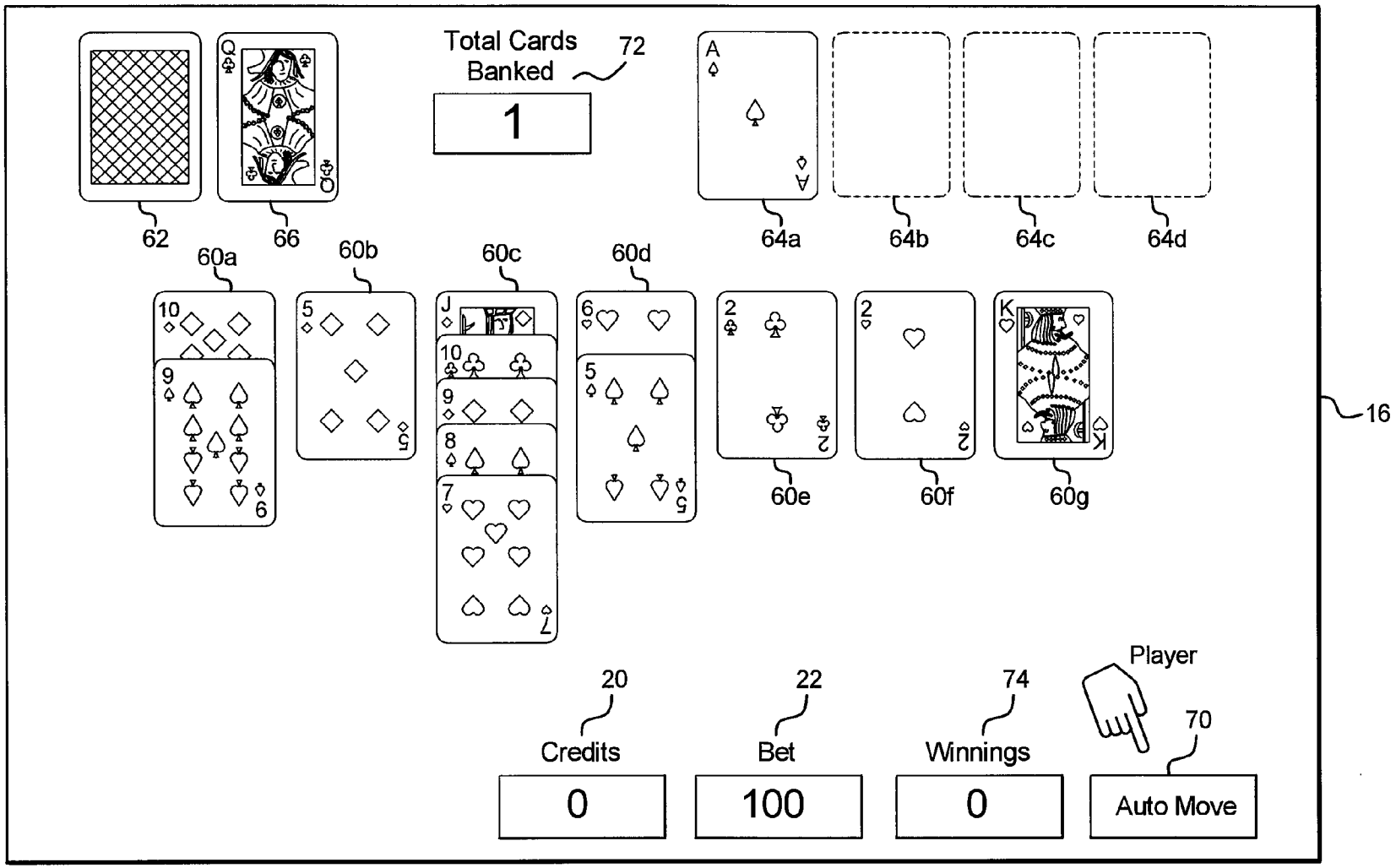

The player selects the Auto Move button 70 two more times. The gaming device builds the eight of spades from pile 60*f* onto the nine of diamonds on pile 60*c*. The two of hearts is then turned face-up on pile 60*f*, as illustrated in FIG. 7E. Then, the gaming device builds the seven of hearts from the discard pile 66 onto the eight of spades, which is now associated with pile 60*c*, as illustrated by FIG. 7E. The queen of clubs is then turned face-up from the stock pile 62 and placed face-up on top of the discard pile 66, as illustrated in FIG. 7E.

Figure 7F:
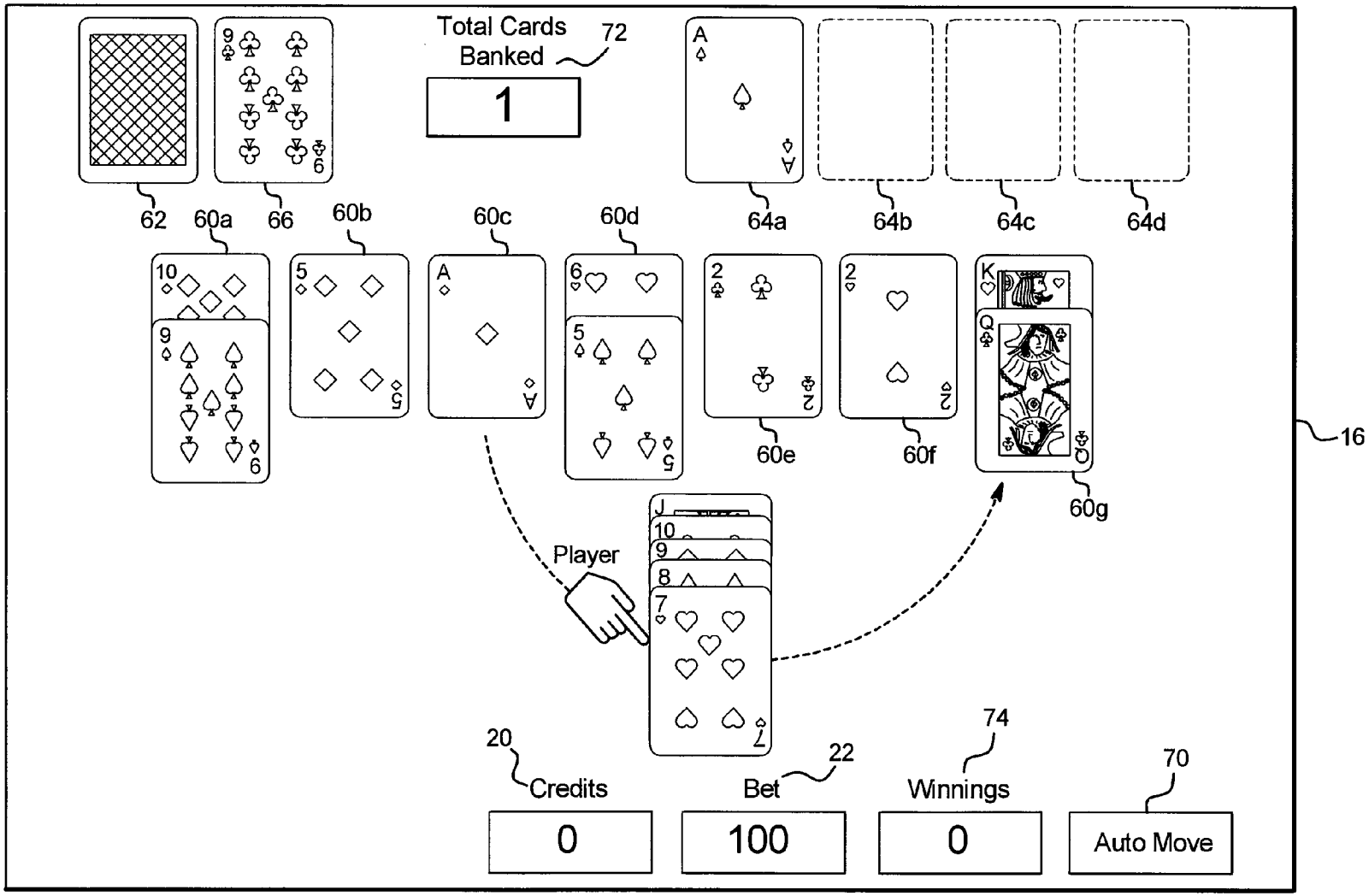
Figure 7G:
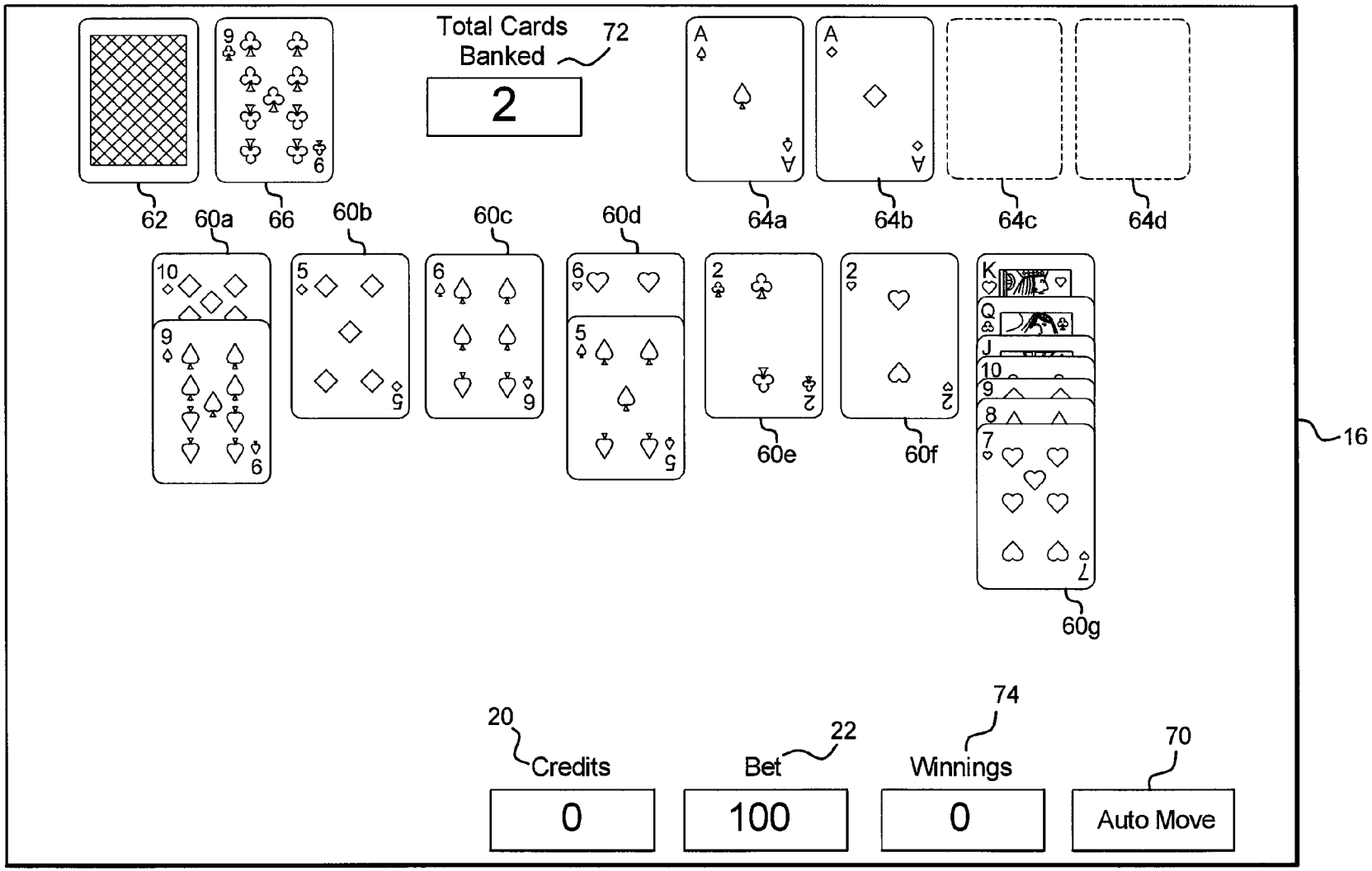

The player makes their next two moves manually. First, the player builds the queen of dubs from the discard pile 66 onto the king of hearts on pile 60*g*, as illustrated in FIG. 7F. Then, the player builds all face-up cards associated with pile 60*c* onto the queen of clubs on pile 60*g*. In this embodiment, the display 16 is a touch screen and the player is able to move the cards from pile 60*c* by "dragging and dropping" the cards on display 16. The player touches the cards associated with pile 60*c* and moves the cards associated therewith along the screen, while holding their finger against the display 16, as illustrated in FIG. 7F. The player moves the cards to pile 60*g*, at which time the player releases their finger from the display 16, thereby "dropping" the cards. It should be appreciated that in other embodiments, the game may be played on a personal computer or PDA, and the player would "click and drag" the cards in a similar manner using a conventional mouse or equivalent control. It should be appreciated that in other embodiments in which the display 16 includes a touch screen, a player moves a card or cards to a desired destination by touching the area of the touch screen at which the card is displayed and then touching the desired destination, not having to "drag" the card or cards across the display 16.

The foregoing two moves result in the turning up of the ace of diamonds on pile 60*c*, as illustrated in FIG. 7F. The player causes the ace of diamonds to be placed in its respective bank 64*b*, raising the number of cards placed in the payout zone to two, as illustrated by the Total Cards Banked display 72 in FIG. 7G.

Figure 7H:
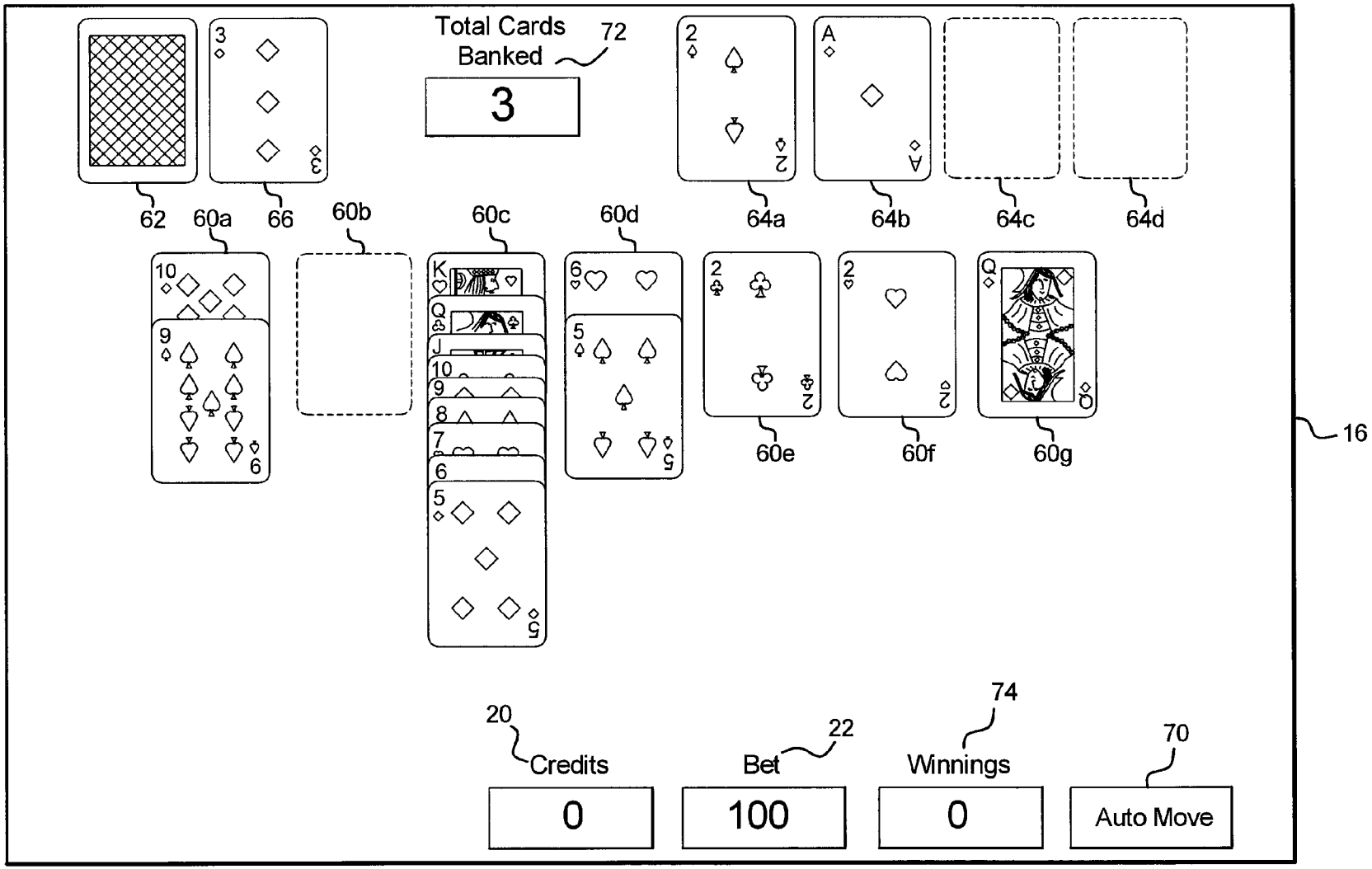

The player selects the Auto Move button 70 five more times. This results in the gaming device making five more moves on behalf of the player. The result of these five moves is illustrated in FIG. 7H. Following these five moves, no cards occupy the position of pile 60*b* because in this embodiment, only a king may occupy an empty position. It should be appreciated that in other embodiments, a player may be able to place other cards in an empty position. During these five moves, the two of spades was moved into payout zone 64*a*. Accordingly, the number of cards placed in the payout zone is now three, as illustrated in the Total Cards Banked display 72 in FIG. 7H.

Figure 7I:
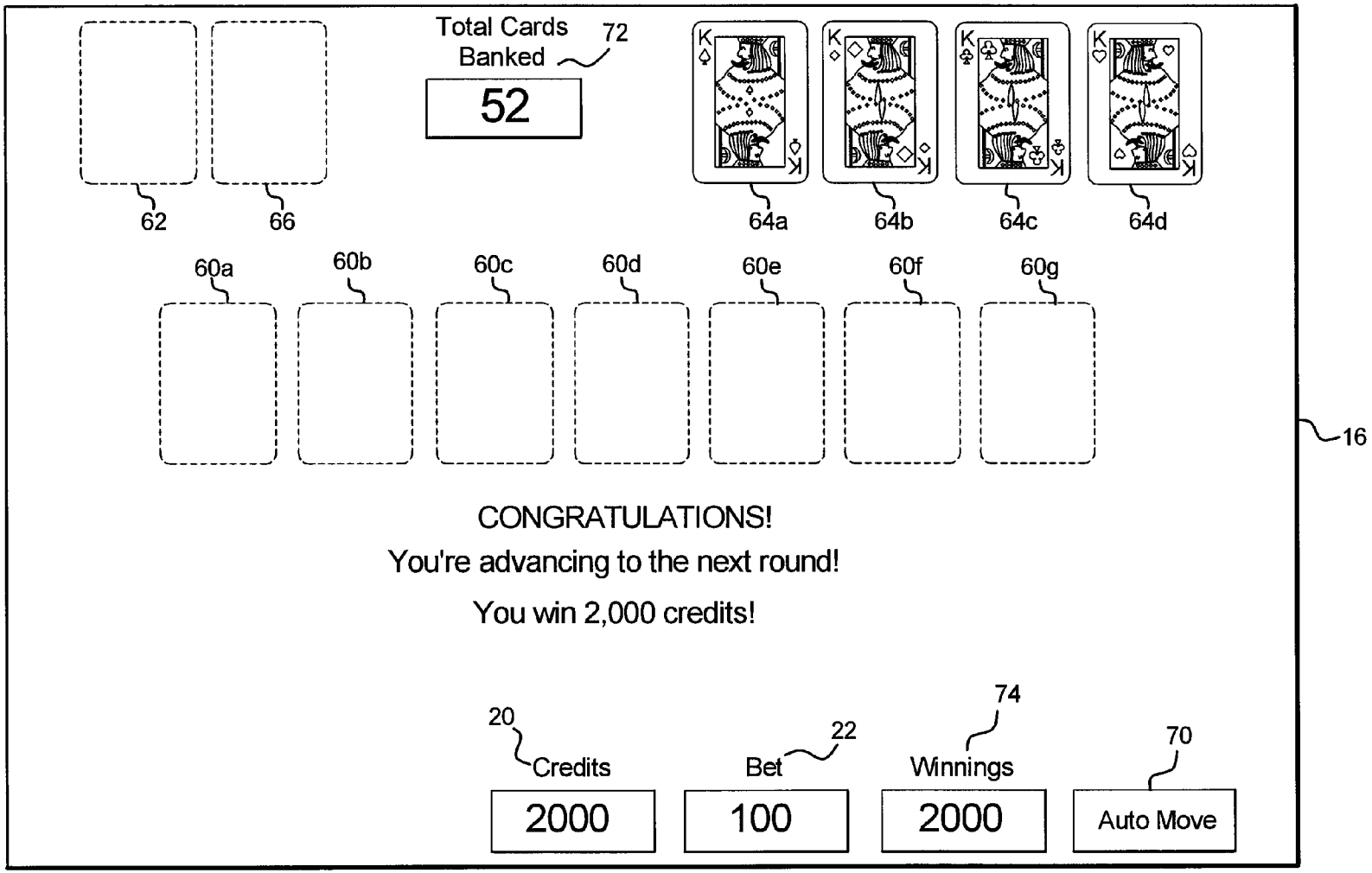

The player uses the Auto Move feature to play the rest of the game. In this example, the gaming device solves the game. Accordingly, 52 cards are placed in the payout zones, as illustrated in FIG. 7I. In this embodiment and others discussed below, for purposes of example, the gaming device uses paytable 90 illustrated in FIG. 5A to determine the player's award. The award associated with 50 to 52 cards being banked in a first stage of play is 2,000 credits, as illustrated in FIG. 5A. Accordingly, the gaming device provides the player with 2,000 credits, as illustrated in the Credits Display 20 and Winnings Display 74 of FIG. 7I. It should be appreciated that in certain embodiments, when a player is mathematically guaranteed to solved the Klondike Solitaire game, the gaming device automatically completes the game, enabling the player to receive their award more quickly. In such embodiments, the player does not have to repeatedly select Auto Move 70 or make the moves themselves.

In this embodiment, when a player or the gaming device solves the game, the player automatically advances to a second stage. The second stage includes a play of a newly dealt Klondike Solitaire game. If the player or the gaming device does not solve the first stage, the game is over. If the player or the gaming device solves the game in the second stage, the player automatically advances to a third stage. If the player or gaming device does not solve the game in the second stage, the game is over. In this example, the gaming device advances the player to a second stage of play, as illustrated in FIGS. 7I and 8A.

It should be appreciated that in various embodiments, the awards associated with various game Klondike Solitaire outcomes or events vary or are modified according to any of: (a) what stage of play the player has advanced to; (b) an amount of time (i.e., the duration of the game); (c) the number of payout zones into which cards are placed; or (d) which payout zone or payout zones cards are placed in (i.e., payout may vary by suit or each payout zone may be associated with a multiplier); (e) any suitable combination of these; and (f) any other suitable criteria. In one embodiment, awards are modified by a modifier (i.e., a multiplier) which in different embodiments, is predetermined, randomly determined, determined based on the player's status (such as determined through a player tracking system), determined based on time, determined based on a random determination by the central controller, determined based on a random determination at the gaming machine, determined based on one or more side wagers placed or determined based on any other suitable method or criteria.

Figure 8A:
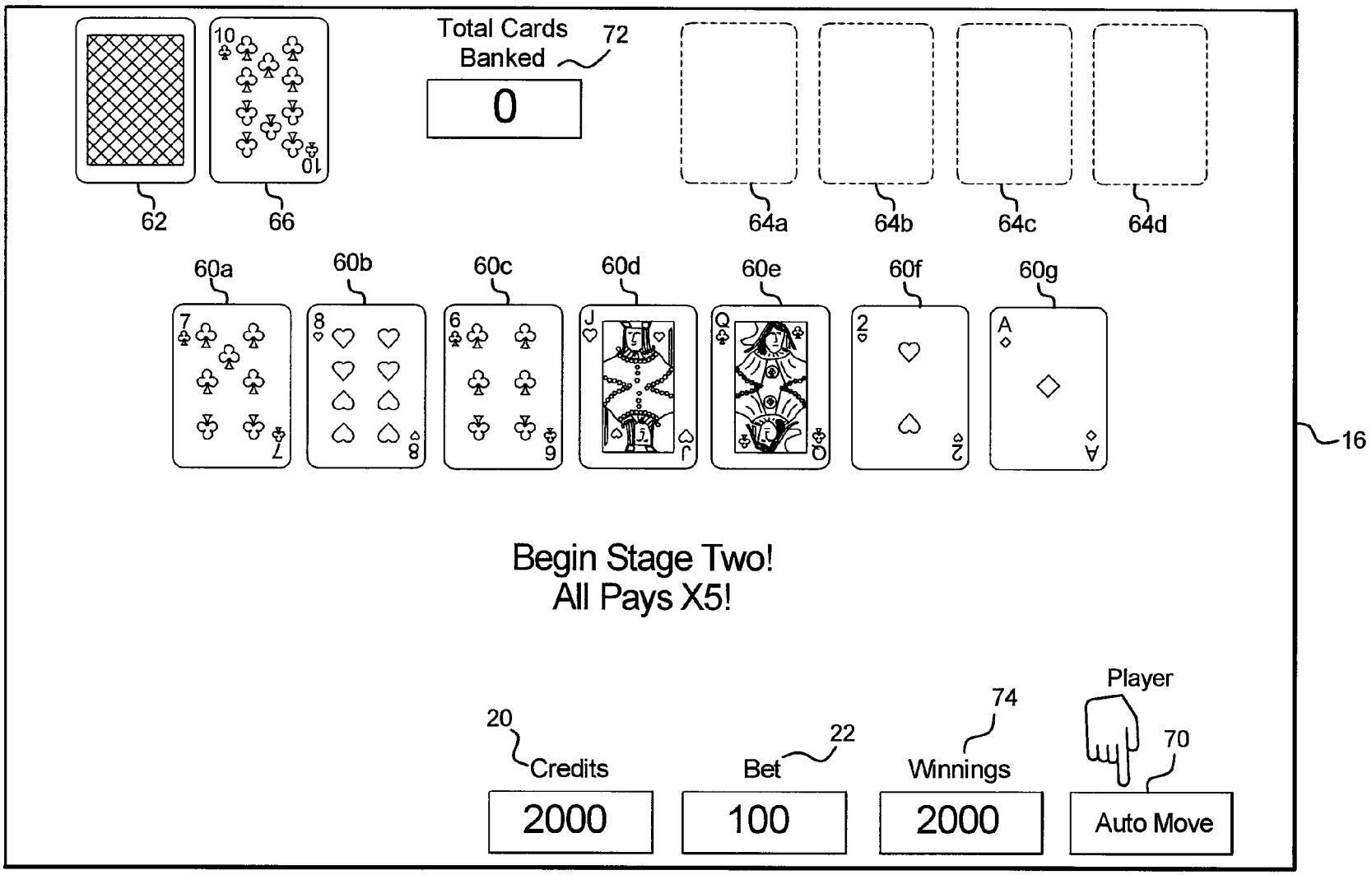
FIGS. 8A, 8B and 8C include front views of a gaming device display enabling the play of game in accordance with one embodiment of the gaming system, gaming device and method disclosed herein.

It should be appreciated that the example paytable 90 includes awards which are modified by a multiplier in the second and third stages of game play, as illustrated in FIGS. 5A and 8A. In the second stage, each of the awards in the paytable 90 are multiplied by five, as illustrated in FIG. 5A.

Figure 8B:
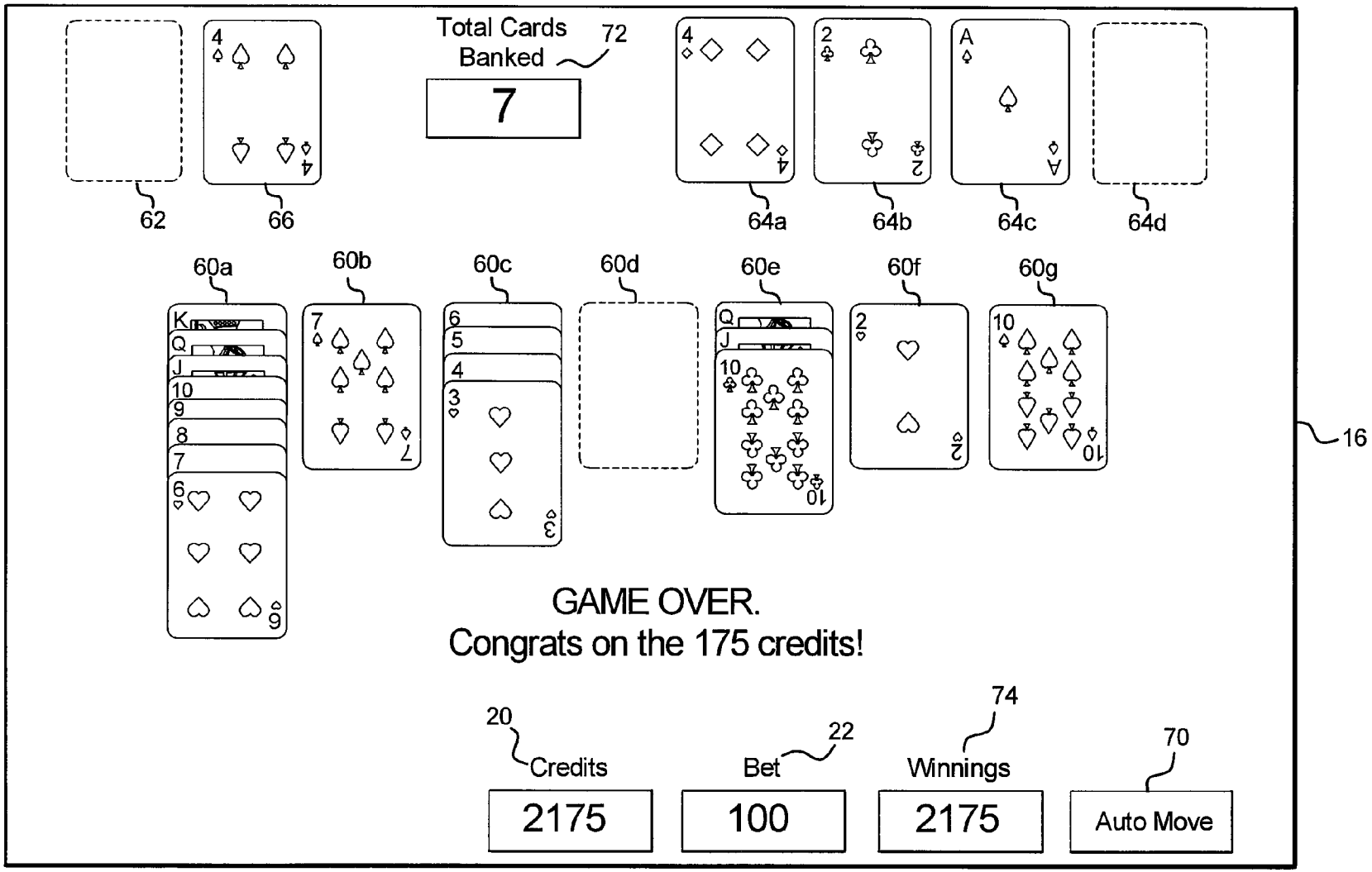

The player utilizes the Auto Move feature for the entire play of the second stage by repeatedly selecting the Auto Move button 70, as illustrated in FIG. 8A. The outcome of the second stage of the game is illustrated in FIG. 8B. Seven cards are banked, as illustrated in FIG. 8B. The gaming device uses the paytable 90 to determine the player's award. The award associated with the range of five to nine cards being banked in the second stage of the game is 175 credits (as opposed to 35 credits in the first stage of play and 700 credits in a third stage of play), as illustrated in FIG. 5A. Accordingly, the gaming device provides the player with an award of 175 credits, as illustrated in FIG. 8B.

Figure 8C:
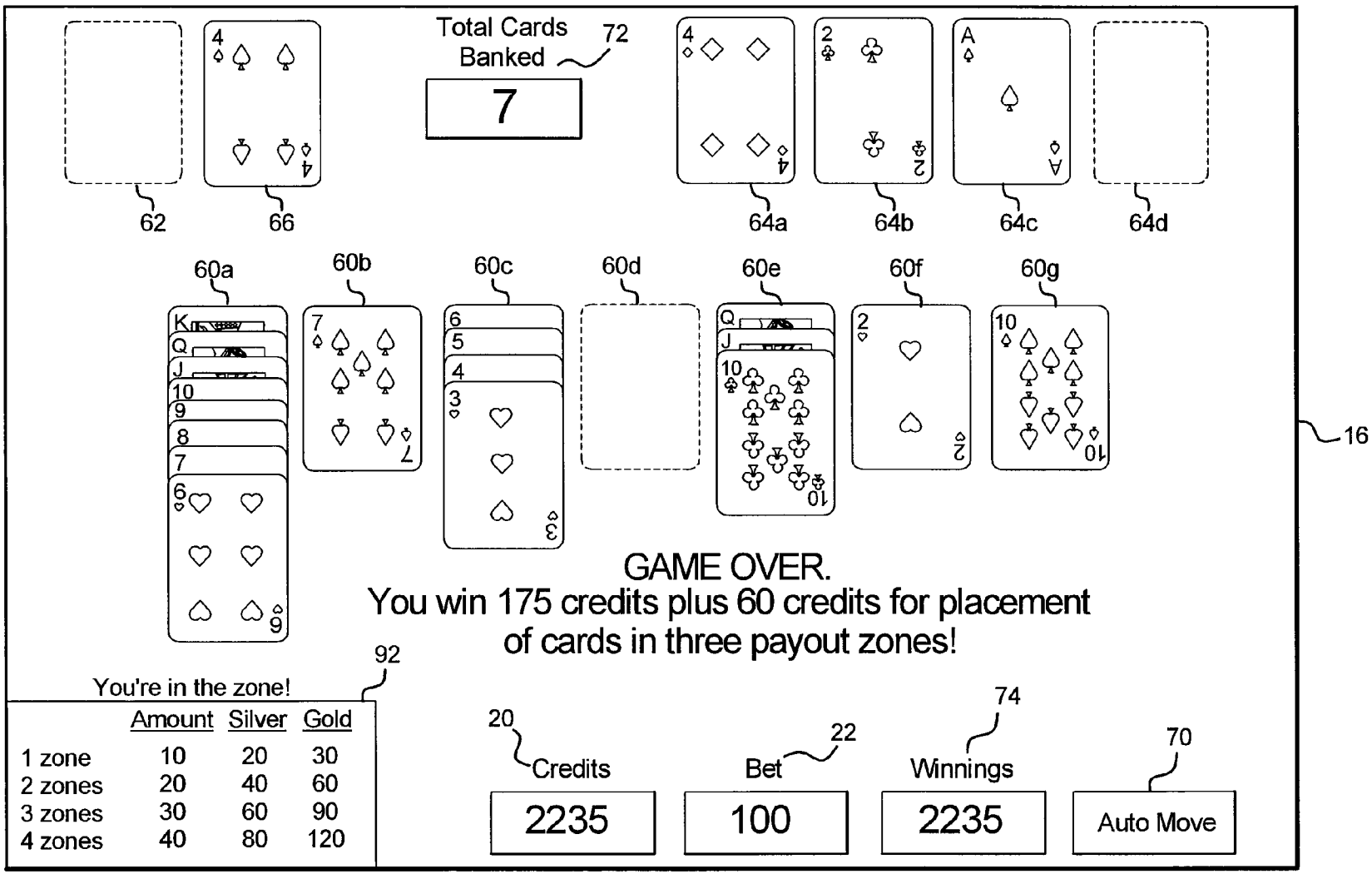

In one embodiment, the gaming device provides the player with a bonus award for each payout zone into which cards are placed during a play of the game, as illustrated in the alternative outcome of FIG. 8C. In this embodiment, at least one card was placed in each of the banks, or payout zones, 64*a*, 64*b* and 64*c* as illustrated in FIG. 8C. The gaming device uses paytable 92 to determine the player's bonus award. The bonus award associated with the placement of cards into three payout zones in the second stage of play in paytable 92 is 60 credits, as illustrated in FIG. 8C. Accordingly, the gaming device provides the player with 60 credits in addition to the 175 credits the player receives for their primary award, as illustrated in FIG. 8C.

Figure 9A:
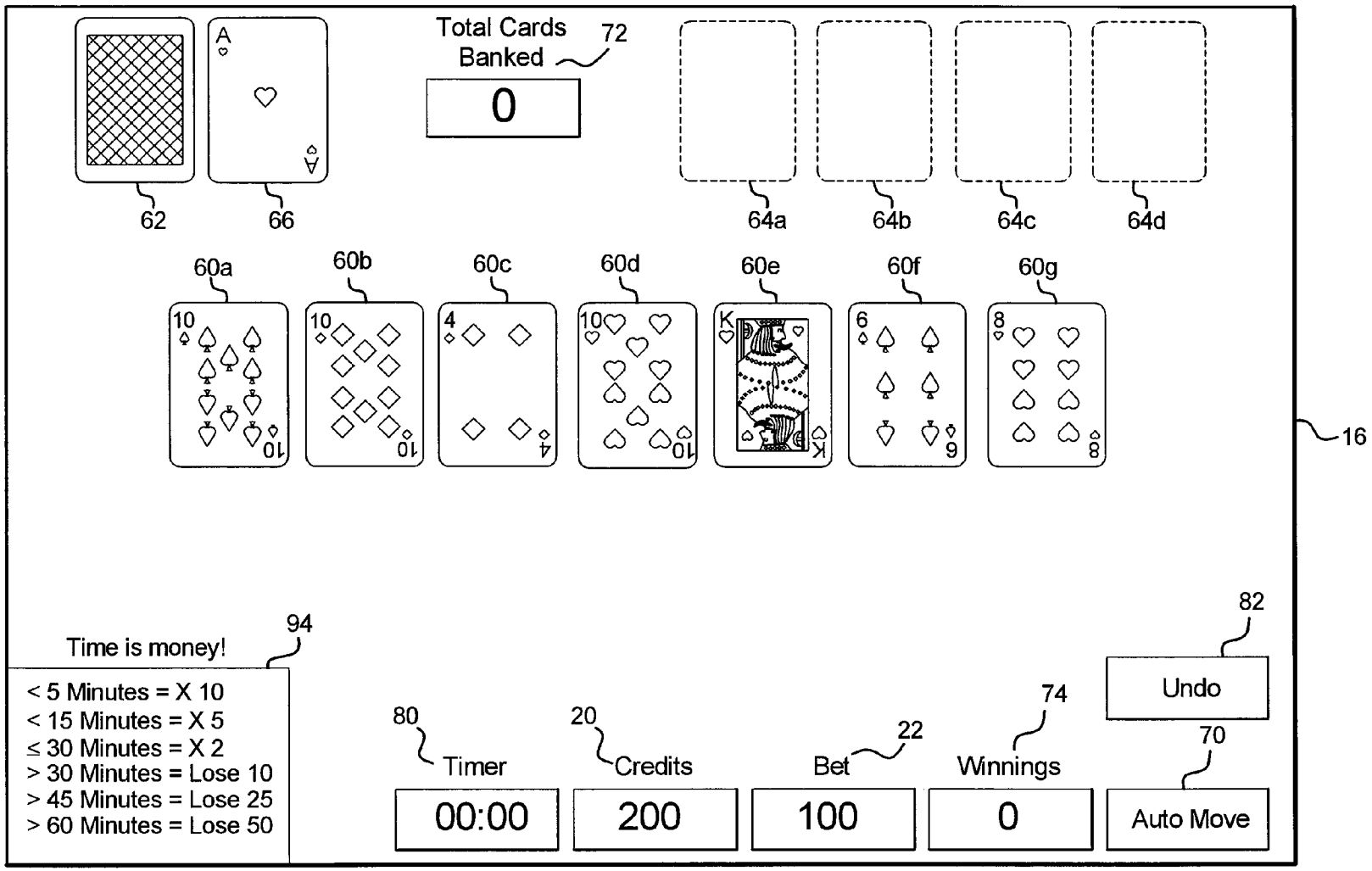
FIGS. 9A, 9B, 9C and 9D include front views of a gaming device display enabling the play of game in accordance with one embodiment of the gaming system, gaming device and method disclosed herein.

Now referring to FIGS. 9A to 9D, in one embodiment, awards are modified as a function of how long it takes the player to play or cause the gaming device to play the game. In this embodiment, the display 16 includes a timer 80 which tracks the time elapsed during game play. The timer resets each time the player begins play of a new game or a new stage. It should be appreciated that in other embodiments, the timer times the total play time of multiple stages. The paytable 94 includes modifiers and credit deductions associated with varying game play time criteria, as illustrated in FIG. 9A. For example, if the player completes or causes the completion of a play of the game in under five minutes, any award the player receives is multiplied by ten as illustrated in FIG. 9A.

Also, in this embodiment, the gaming device enables the player to "undo" one or more moves performed by the player or the gaming device. In this embodiment, the gaming device charges the player a designated amount of credits to undo one or moves. It should be appreciated that in other embodiments, the gaming device enables the player to undo one or more moves for free. In an alternative embodiment, the gaming device charges the player a certain number of credits each time the player moves a card from the discard pile or performs other designated moves.

Figure 9B:
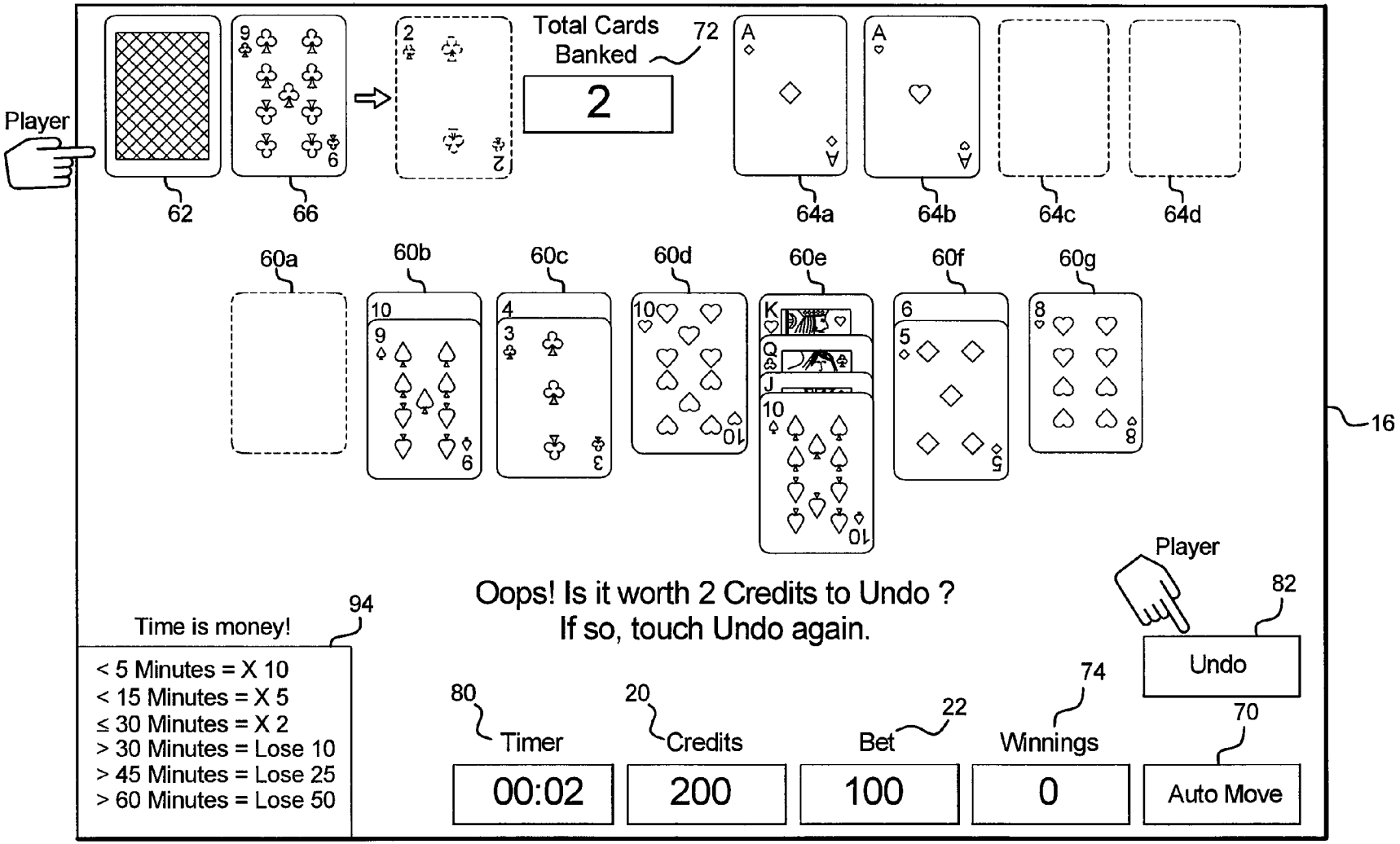
Figure 9C:
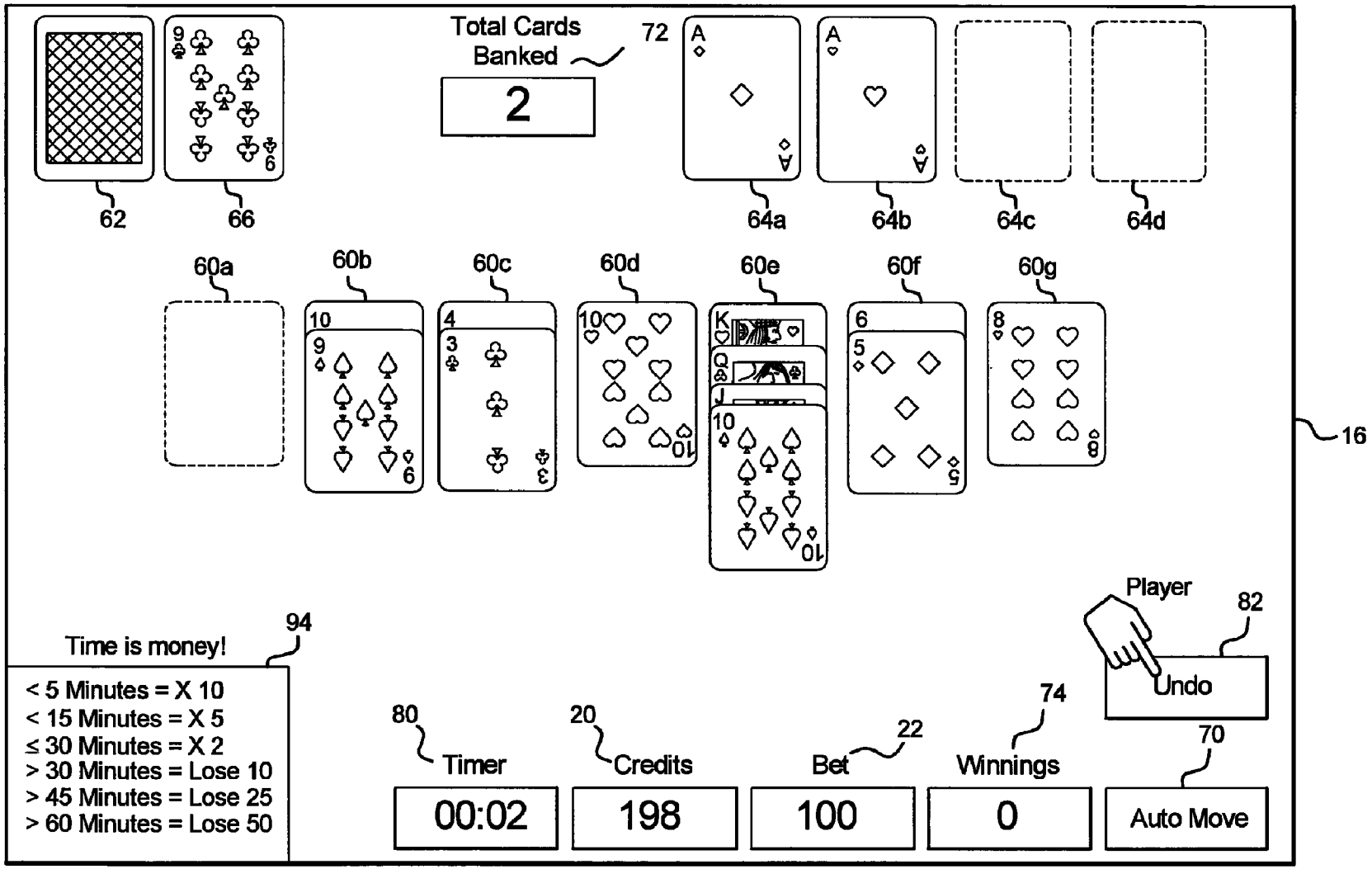
Figure 9D:
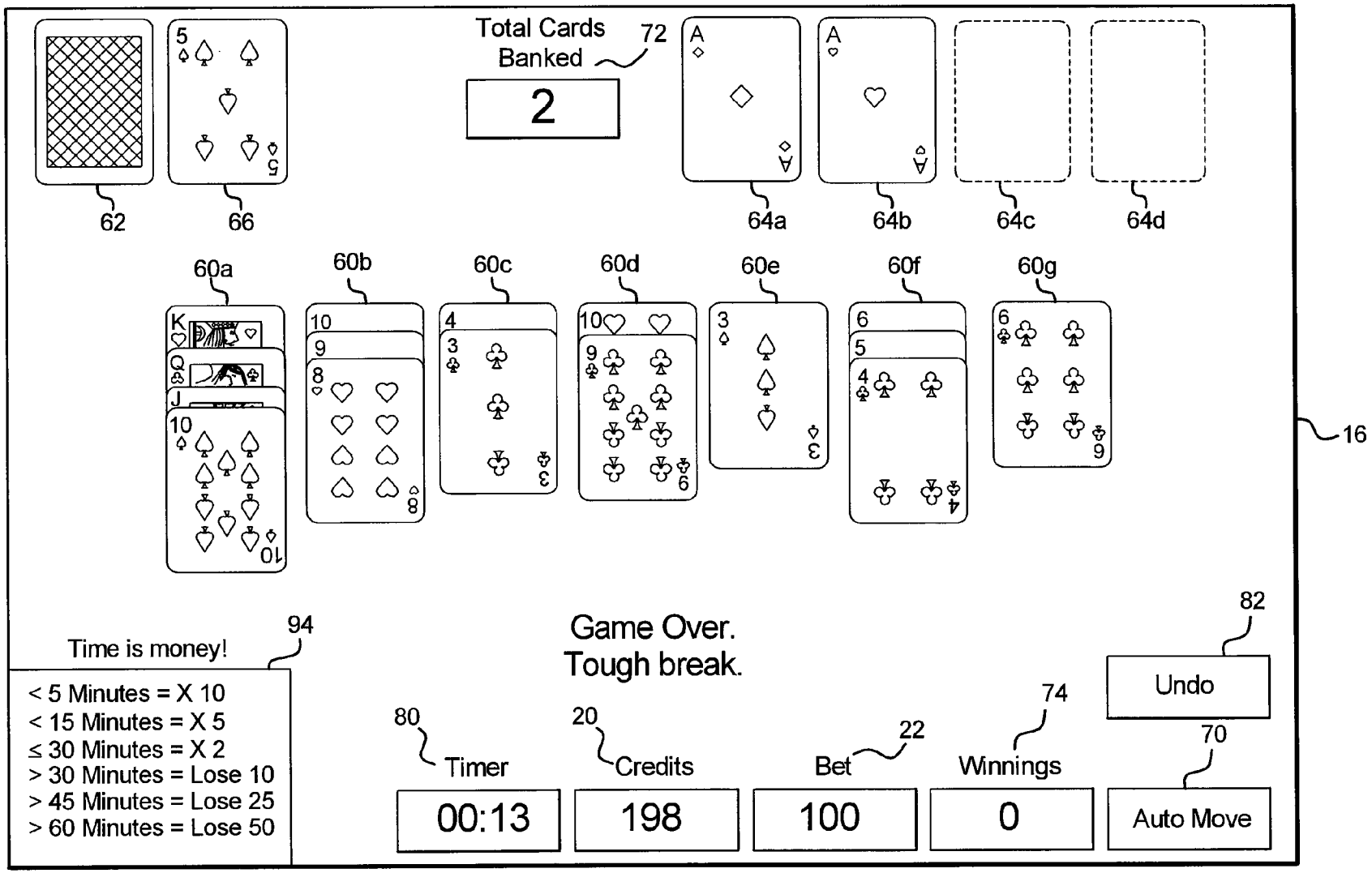

In one example, the player places a wager of 100 credits to play the Klondike Solitaire game as illustrated in FIG. 9A. At one point during play of the game, a nine of clubs is face-up on the discard pile 66, as illustrated in FIG. 9B. The player touches the stock pile 62 to turn over the next card from the stock pile 62 as illustrated in FIG. 9B. The next card is a two of clubs as illustrated in FIG. 9B. The player meant to build the nine of clubs onto the ten of hearts on pile 60*d* prior to touching the stock pile 62. The player touches the Undo button 82 as illustrated in FIG. 9B. The display 16 informs the player that it will cost two credits to undo the move as illustrated in FIG. 9B. The player confirms that they wish to undo the move as illustrated in FIG. 9C. Thus, the two of clubs is placed face-down back into the stock pile 62 and the players credits go from 200 to 198 as illustrated in FIG. 9C. Upon completion of play of the game, two cards are banked in the payout zones, as illustrated in FIG. 9D. In accordance with the paytable 90, the player is not entitled to any award as illustrated in FIGS. 5A and 9D.

Figure 10A:
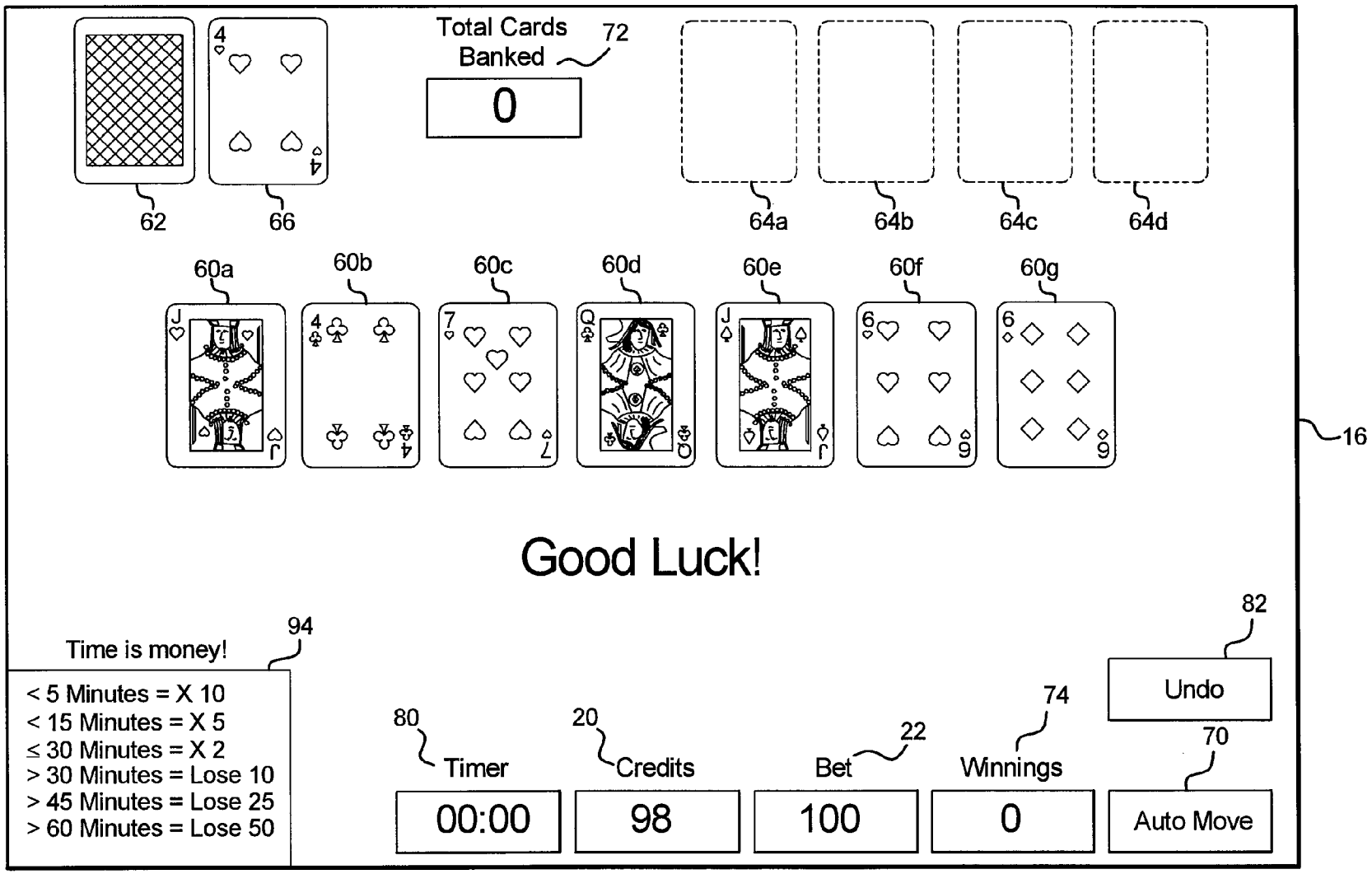
FIGS. 10A and 10B include front views of a gaming device display enabling the play of game in accordance with one embodiment of the gaming system, gaming device and method disclosed herein.
Figure 10B:
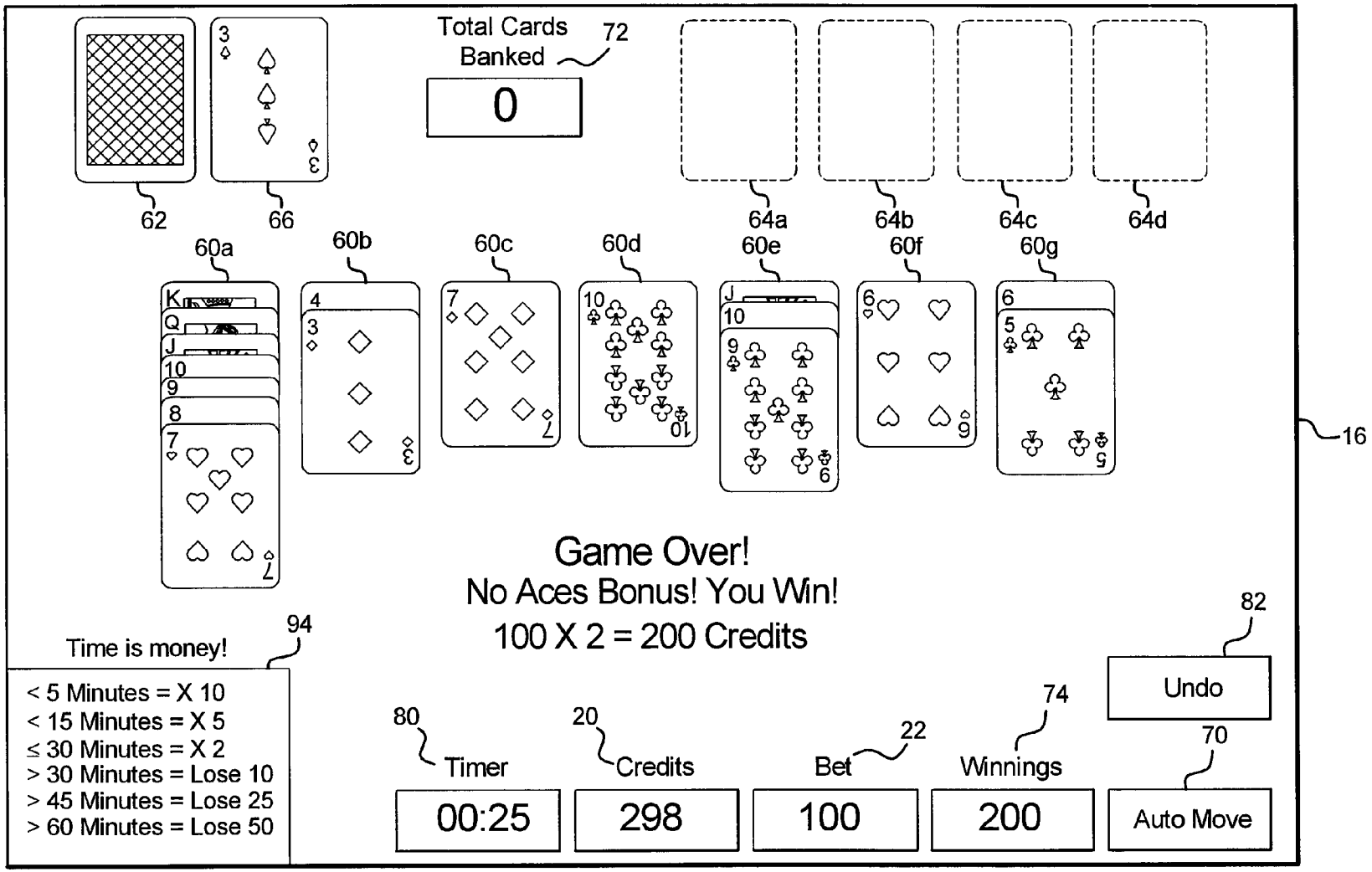

Referring now to FIG. 10A, the player immediately places a wager of 100 credits for another play of the game and the time on the timer 80 resets to zero. At the end of play of the game, no cards are banked and 25 minutes have elapsed, as illustrated in FIG. 10B. Again, in this example, the gaming device uses paytable 90 to determine if the player is entitled to any award. The player is entitled to an award of 100 credits for zero cards banked, as illustrated in FIGS. 5A and 10B. The gaming device uses paytable 94 to determine if the award needs modified based on the player's completion of the play of the game in 25 minutes. The player's award of 100 credits is multiplied by two because the player played the game in under 30 minutes as illustrated in FIG. 10B. Accordingly, the gaming machine provides the player with an award of 200 credits as illustrated in FIG. 10B.

In one embodiment, the gaming device is configured to recognize a player's style of play and thus be at least someone reflexive. Once the gaming device has recognized a players style of play, in various embodiments, the gaming device may: (a) place a player in a certain style category having its own set of outcome probabilities and related paytable; or alternatively (b) run an optimizer using the player's strategy as that input into the optimizer, with the optimizer outputting a set of probabilities specific for that player. Each of the style categories may be associated with its own respective paytable. In one embodiment, once a player's style is categorized, the gaming device assigns a certain alternative paytable associated with that style to the player's play or plays of the game. In another embodiment, if an optimizer determines a set of probabilities associated with a player's specific style, the gaming device creates a paytable specifically for that player. In that embodiment, the gaming device adjusts awards in a paytable for future plays of the game by the player such that the paytable achieves a designated average expected payback percentage.

It should be appreciated that in various embodiments, each payout zone or bank has its own paytable. In various such embodiments, one or more of the paytables associated with the respective payout zones are different. In such embodiments, a player could have a same number of cards banked at the end of each of two plays of the game, but receive a different award, based on which payout zones the respective cards were banked in for each play of the game. Differences in the magnitude of awards in the paytables associated with respective payout zones in such embodiments could influence a player's strategy. In other embodiments, red suits (diamonds and hearts) and black suits (clubs and spades) could each have their own respective paytables.

It should be appreciated that the designated game strategies utilized by the gaming device in automatic mode may be the same as those input into the optimizer or different than those input into the optimizer. In one embodiment disclosed herein, the game play strategies utilized by the optimizer and the gaming device in automatic mode are the same. Accordingly, in that embodiment, the probabilities associated with actual game play in automatic mode are substantially identical to those predicted by the optimizer.

In one embodiment, the gaming system enables the player to begin play of the Klondike Solitaire game with various predetermined or randomly determined mid-game scenarios. When a player begins play with a mid-game scenario, the player begins play of a game which has automatically been played up to a designated point and begins play of the game at that designated point. Any suitable method may be employed to get to the designated mid-game point.

In another embodiment, the gaming system enables players to play in a Klondike Solitaire tournament. Tournament play may begin randomly or upon the occurrence of a designated triggering or starting event or time. During tournament play in various embodiments, participating players play the same dealt Klondike Solitaire game (i.e., play head-to-head) or play different Klondike Solitaire games and compete on the basis of number of cards placed in the payout zones or other criteria. It should be appreciated that the designated triggering event triggering tournament play could be any of: (a) exceeding a certain amount of game play (such as number of games, number of credits, or amount of time); (b) reaching a specified number of credits earned during game play; or (c) any other suitable event.

In one embodiment, the Klondike Solitaire game is associated with one or more progressive or multi-level progressive awards as discussed above and adapted to be provided to a player. In one embodiment, a player's eligibility for a progressive or multi-level progressive award is a function of the amount of time it takes the player to play the game. In other words, if a player is playing too slow, the player is not eligible for a progressive or multi-level progressive award. Any other suitable function can be used to provide the player such progressive awards.

Figure 11:
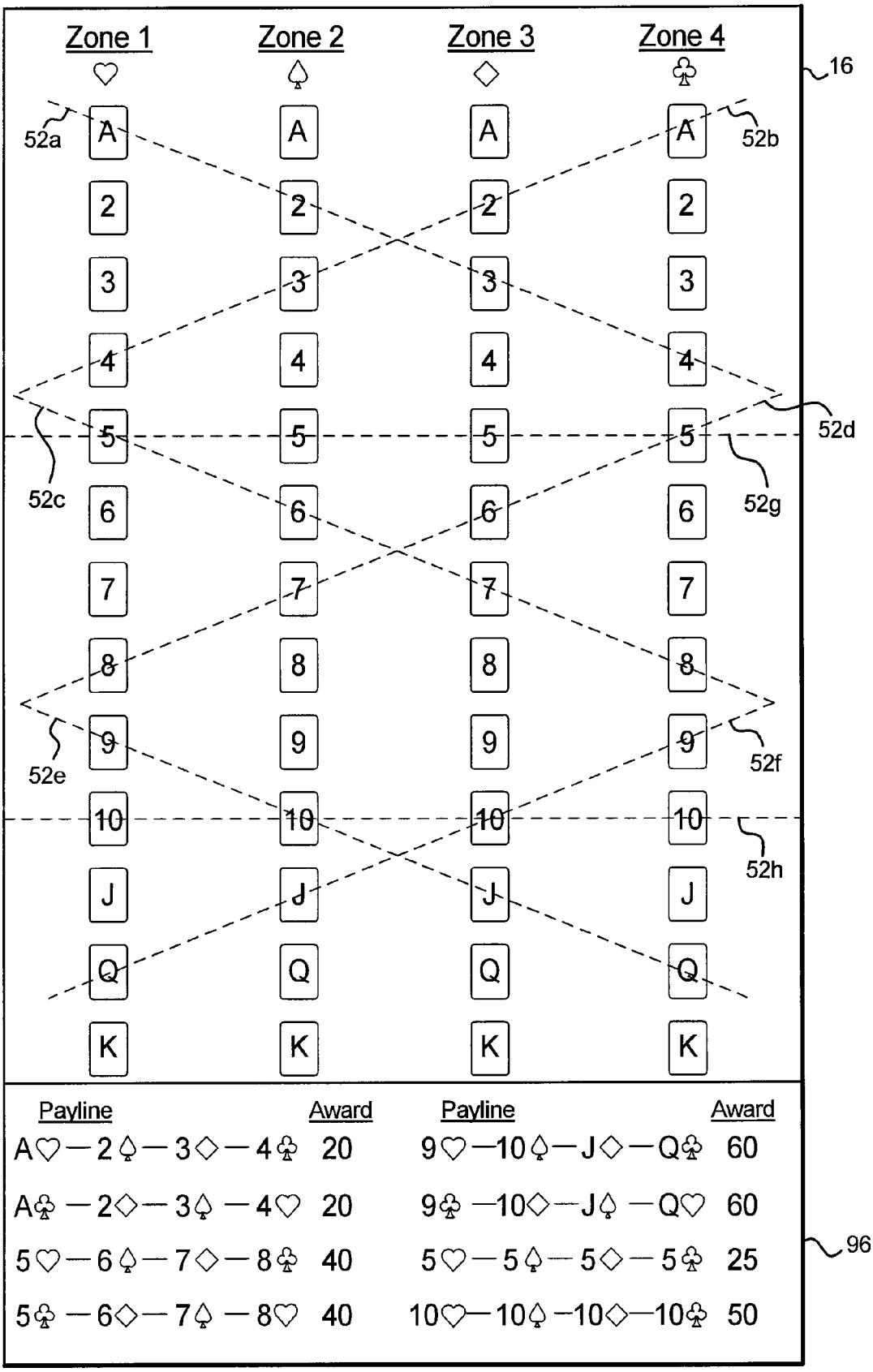
FIG. 11 includes a front view of a gaming device display enabling the viewing of paylines associated with one embodiment of the gaming system, gaming device and method disclosed herein and a paytable associated with the paylines.

In another embodiment, a player wagers on the placement of certain cards in the payout zones. When laid out, the cards in the payout zones at the end of a play of the game lie on paylines, such as those one would wager on when playing a slot-type game. Prior to prompting the player to place a wager on a Klondike Solitaire game, the display 16 illustrates a variety of paylines 52*a* to 52*h* to the player and a paytable 96 associated therewith, as illustrated in FIG. 11. If a player places a wager of one credit on payline 52*a* and at the end of a play of the game, has placed an ace of hearts, two of spades, three of diamonds and four of clubs in the payout zones, the player would receive an award of 20 credits (wager of one credit multiplied by award of 20 credits), as determined from paytable 96. It should be appreciated that paylines 52*a* to 52*h* are only for purposes of example. Paylines could run across any number of cards in any direction.

It should be appreciated that although this disclosure focuses on Klondike Solitaire, any and all of the gaming devices, games and methods disclosed herein may be adapted to other versions of solitaire.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention claimed is:

1. A gaming system comprising:

at least one input device;

at least one display device;

at least one processor; and at least one memory device storing a plurality of instructions, which when executed by the at least one processor, cause the at least one processor to operate with the at least one input device and the at least one display device for a play of a solitaire game using 52 cards to:

(i) provide a plurality of card field piles;

(ii) provide a card stock pile which includes a plurality of the 52 cards;

(iii) display, in response to communications received from the at least one input device, each of the plurality of the 52 cards from the card stock pile being placed in:

(a) one of the card field piles, (b) one of a plurality of payout zones, or (c) a discard pile;

(iv) display, in response to communications received from the at least one input device in accordance with a set of predefined rules for the solitaire game, at least one card from the card field piles being placed in:

(a) a different one of the card field piles, or (b) one of the plurality of payout zones;

(v) end the play of the solitaire game after any of the plurality of the 52 cards remaining in the card stock pile can only be placed in the discard pile, wherein the displayed placement of the cards when the game ends defines one of a plurality of outcomes, the outcomes at least including:

(a) a first outcome including a first number of the 52 cards placed in the payout zones, wherein a first award is associated with the first outcome, (b) a second outcome including a second different number of the 52 cards placed in the payout zones, wherein a second award is associated with the second outcome, wherein the ratio of the first award to the first number of the 52 cards placed in the payout zones is different than the ratio of the second award to the second number of the 52 cards placed in the payout zones, and (c) a third outcome including a third different number of the 52 cards placed in the payout zones, said third different number being different than said first number and different than said second number, wherein a third award is associated with the third outcome, wherein the ratio of the third award to the third number of the 52 cards placed in the payout zones is different than the ratio of the first award to the first number of the 52 cards placed in the payout zones and different than the ratio of the second award to the second number of the 52 cards placed in the payout zones, and wherein the plurality of outcomes are each associated with an award which in part defines a paytable, wherein the paytable has an average expected payback percentage less than 100%; and (vi) provide any award associated with the displayed outcome.

2. The gaming system of claim 1, wherein the paytable includes outcomes selected from the group consisting of: (a) the placement of a designated number of the 52 cards in one of the payout zones, (b) the placement of a designated range of numbers of the 52 cards in one of the payout zones, (c) the placement of a total designated number of the 52 cards in the payout zones collectively, and (d) the placement of a designated range of numbers of the 52 cards in the payout zones collectively.

3. The gaming system of claim 1, wherein the paytable includes at least one bonus outcome selected from the group consisting of: (a) the placement of at least one designated card in the payout zones, (b) the placement of at least a designated number of the 52 cards in each of the payout zones, (c) the placement of at least a designated number of the 52 cards in a certain payout zone, (d) the placement of thirteen of the 52 cards in one or more of the payout zones, and (e) the completion of the play of the solitaire game within a designated period.

4. The gaming system of claim 1, wherein the paytable includes a winning outcome associated with the placement of zero of the 52 cards in the payout zones.

5. The gaming system claim 1, wherein the play includes multiple stages of play of the solitaire game, each stage of play using 52 cards.

6. The gaming system of claim 5, wherein the plurality of instructions, when executed by the at least one processor, cause the at least one processor to initiate a subsequent stage of play of the solitaire game.

7. The gaming system of claim 1, wherein the plurality of instructions, when executed by the at least one processor, cause the at least one processor to enable manual and automatic modes of play of the solitaire game.

8. The gaming system of claim 7, wherein the plurality of instructions, when executed by the at least one processor, cause the at least one processor to operate with the at least one display device to display a plurality of cards being placed according to the predefined rules during the play of the solitaire game.

9. The gaming system of claim 8, wherein the at least one processor operates with the at least one display device to display one or more of the plurality of the 52 cards being placed according to designated strategies.

10. The gaming system of claim 1, wherein the plurality of instructions, when executed by the at least one processor, cause the at least one processor to operate with the at least one display device to assist a player during the play of the solitaire game if one or more of the following is true: (a) a designated period of time has passed between placements, and (b) only one card placement is available according to the set of predefined rules.

11. The gaming system of claim 10, wherein the at least one processor operates with the at least one display device to one or more of: (a) suggest card placements to the player within the confines of the set of predetermined rules and (b) make card placements for the player according to the set of predefined rules.

12. The gaming system of claim 1, wherein the plurality of instructions, when executed by the at least one processor, cause the at least one processor to operate with the at least one display device and the at least one input device to enable a player to undo one or more card placements.

13. The gaming system of claim 1, wherein the plurality of instructions, when executed by the at least one processor, cause the at least one processor to operate with the at least one display device to initiate the play of the solitaire game at a mid-game scenario.

14. The gaming system of claim 1, wherein the plurality of instructions, when executed by the at least one processor, cause the at least one processor to operate with the at least one input device and the at least one display device to initiate a solitaire tournament.

15. The gaming system of claim 1, wherein the solitaire game is associated with a progressive award.

16. The gaming system of claim 1, wherein the solitaire game is associated with a multi-level progressive award.

17. The gaming system of claim 16, wherein eligibility for the multi-level progressive award is dependent in part on the duration of the play of the solitaire game.

18. The gaming system of claim 1, wherein the plurality of instructions, when executed by the at least one processor, cause the at least one processor to operate with the at least one display device to display, in response to communications received from the at least one input device, each of the plurality of the 52 cards from the card stock pile being placed in the card field piles, wherein cards placed in the card field piles are placed in the respective card field piles in a descending sequence.

19. The gaming system of claim 1, wherein the plurality of instructions, when executed by the at least one processor, cause the at least one processor to operate with the at least one display device to display, in response to communications received from the at least one input device, each of the plurality of the 52 cards from the card stock pile being placed in the card field piles, wherein cards placed in the card field piles are placed in the respective card field piles in a descending sequence, and alternating card color.

20. The gaming system of claim 1, wherein the plurality of instructions, when executed by the at least one processor, cause the at least one processor to operate with the at least one display device to display, in response to communications received from the at least one input device, each of the plurality of the 52 cards from the card stock pile being placed in the plurality of payout zones, wherein cards placed in the payout zones are placed in each respective payout zone in ascending sequence.

21. The gaming system of claim 1, wherein the plurality of instructions, when executed by the at least one processor, cause the at least one processor to operate with the at least one display device to automatically move each card from the card stock pile to the discard pile and display, in response to communications received from the at least one input device, each of a plurality of cards from the discard pile being placed in one of the card field piles or one of the plurality of payout zones.

22. The gaming system of claim 1, wherein the plurality of instructions, when executed by the at least one processor, cause the at least one processor to operate with the at least one display device, to display cards from the card stock pile one at a time.

23. The gaming system of claim 1, wherein the plurality of instructions, when executed by the at least one processor, cause the at least one processor to operate with the at least one input device and the at least one display device, to display cards from the card stock pile three at a time.

24. The gaming system of claim 1, wherein each of the payout zones is associated with a different paytable.

25. The gaming system of claim 1, wherein at least two of the payout zones are associated with different paytables.

26. A gaming system comprising:

at least one input device;

at least one display device;

at least one processor; and at least one memory device storing a plurality of instructions, which when executed by the at least one processor, cause the at least one processor to operate with the at least one input device and the at least one display device to, for a play of a solitaire game using 52 cards:

(i) provide a plurality of card field piles;

(ii) provide a card stock pile which includes a plurality of the 52 cards;

(iii) display, in response to communications received from the at least one input device, each of the plurality of the 52 cards from the card stock pile being placed in:

(a) one of the card field piles, (b) one of a plurality of payout zones, or (c) a discard pile;

(iv) display, in response to communications received from the at least one input device in accordance with a set of predefined rules for the solitaire game, at least one card from the card field piles being placed in:

(a) a different one of the card field piles, or (b) one of the plurality of the payout zones;

(v) end the play of the solitaire game after any of the plurality of the 52 cards remaining in the card stock pile can only be placed in the discard pile, wherein the displayed placement of the cards when the game ends defines one of a plurality of outcomes, the outcomes at least including:

(a) a first outcome including a first range of the 52 cards placed in the payout zones, wherein a first award is associated with the first outcome, (b) a second outcome including a second different range of the 52 cards placed in the payout zones, wherein a second different award is associated with the second outcome, the second award being greater than the first award, the ratio of the first award to the first range of the 52 cards placed in the payout zones being different than the ratio of the second award to the second range of the 52 cards placed in the payout zones, and the number of cards placed in the payout zones in the second range being greater than the number of cards placed in the payout zones in the first range, and (c) a third outcome including a third different range of the 52 cards placed in the payout zones, said third different range being different than the first range and different than the second range, wherein a third different award is associated with the third outcome, the third award being greater than the second award, the ratio of the third award to the third range of the 52 cards placed in the payout zones being different than the ratio of the second award to the second range of the 52 cards placed in the payout zones, and the number of cards placed in the payout zones in the third range being greater than the number of cards placed in the payout zones in the second range, and wherein the plurality of outcomes are each associated with an award which in part defines a paytable, wherein the paytable has an average expected payback percentage less than 100%; and (vi) provide any award associated with the displayed outcome.

27. The gaming system of claim 26, wherein the paytable includes an outcome associated with the placement of zero of the 52 cards in the payout zones.

28. The gaming system claim 26, wherein the play includes multiple stages of play of the solitaire game, each stage of play using 52 cards.

29. The gaming system of claim 26, wherein the paytable includes multiple awards associated with each of the first and second outcomes, each of the awards associated with a different stage of play.

30. The gaming system of claim 28, wherein the awards increase with the stage of play.

31. The gaming system of claim 26, wherein the paytable includes for a first stage of play of the game and a 100 credit wager:

(a) a 100 credit award associated with 0 of the 52 cards placed in the payout zones;

(b) a 35 credit award associated with a range of 5 to 9 of the 52 cards placed in the payout zones;

(c) a 50 credit award associated with a range of 10 to 14 of the 52 cards placed in the payout zones;

(d) a 100 credit award associated with a range of 15 to 19 of the 52 cards placed in the payout zones;

(e) a 200 credit award associated with a range of 20 to 24 of the 52 cards placed in the payout zones;

(f) a 400 credit award associated with a range of 25 to 29 of the 52 cards placed in the payout zones;

(g) a 750 credit award associated with a range of 30 to 34 of the 52 cards placed in the payout zones;

(h) a 1,000 credit award associated with a range of 35 to 49 of the 52 cards placed in the payout zones; and (i) a 2,000 credit award associated with a range of 50 to 52 of the 52 cards placed in the payout zones.

32. The gaming system of claim 26, wherein the paytable includes for a second stage of play of the game and a 100 credit wager:

(a) a 500 credit award associated with 0 of the 52 cards placed in the payout zones;

(b) a 175 credit award associated with a range of 5 to 9 of the 52 cards placed in the payout zones;

(c) a 250 credit award associated with a range of 10 to 14 of the 52 cards placed in the payout zones;

(d) a 500 credit award associated with a range of 15 to 19 of the 52 cards placed in the payout zones;

(e) a 1,000 credit award associated with a range of 20 to 24 of the 52 cards placed in the payout zones;

(f) a 2,000 credit award associated with a range of 25 to 29 of the 52 cards placed in the payout zones;

(g) a 3,750 credit award associated with a range of 30 to 34 of the 52 cards placed in the payout zones;

(h) a 5,000 credit award associated with a range of 35 to 49 of the 52 cards placed in the payout zones; and (i) a 10,000 credit award associated with a range of 50 to 52 of the 52 cards placed in the payout zones.

33. The gaming system of claim 26, wherein the paytable includes for a third stage of play of the game and a 100 credit wager:

(a) a 2,000 credit award associated with 0 of the 52 cards placed in the payout zones;

(b) a 700 credit award associated with a range of 5 to 9 of the 52 cards placed in the payout zones;

(c) a 1,000 credit award associated with a range of 10 to 14 of the 52 cards placed in the payout zones;

(d) a 2,000 credit award associated with a range of 15 to 19 of the 52 cards placed in the payout zones;

(e) a 4,000 credit award associated with a range of 20 to 24 of the 52 cards placed in the payout zones;

(f) an 8,000 credit award associated with a range of 25 to 29 of the 52 cards placed in the payout zones;

(g) a 15,000 credit award associated with a range of 30 to 34 of the 52 cards placed in the payout zones;

(h) a 20,000 credit award associated with a range of 35 to 49 of the 52 cards placed in the payout zones; and (i) a 500,000 credit award associated with a range of 50 to 52 of the 52 cards placed in the payout zones.

34. The gaming system of claim 26, wherein the plurality of instructions, when executed by the at least one processor, cause the at least one processor to operate with the at least one display device to display, in response to communications received from the at least one input device, each of the plurality of the 52 cards from the card stock pile being placed in the card field piles, wherein cards placed in the card field piles are placed in the respective card field piles in a descending sequence.

35. The gaming system of claim 26, wherein the plurality of instructions, when executed by the at least one processor, cause the at least one processor to operate with the at least one display device to display, in response to communications received from the at least one input device, each of the plurality of the 52 cards from the card stock pile being placed in the card field piles, wherein cards placed in the card field piles are placed in the respective card field piles in a descending sequence, and alternating card color.

36. The gaming system of claim 26, wherein the plurality of instructions, when executed by the at least one processor, cause the at least one processor to operate with the at least one display device to display, in response to communications received from the at least one input device, each of the plurality of the 52 cards from the card stock pile being placed in one of the plurality of payout zones, wherein cards placed in the payout zones are placed in each respective payout zone in ascending sequence.

37. The gaming system of claim 26, wherein the plurality of instructions, when executed by the at least one processor, cause the at least one processor to operate with the at least one display device to automatically move each card from the card stock pile to the discard pile and display, in response to communications received from the at least one input device, each of a plurality of cards from the discard pile being placed in one of the card field piles or one of the plurality of payout zones.

38. The gaming system of claim 26, wherein the plurality of instructions, when executed by the at least one processor, cause the at least one processor to operate with the at least one display device, to display cards from the card stock pile one at a time.

39. The gaming system of claim 26, wherein the plurality of instructions, when executed by the at least one processor, cause the at least one processor to operate with the at least one display device, to display cards from the card stock pile three at a time.

40. The gaming system of claim 26, wherein each of the payout zones is associated with a different paytable.

41. The gaming system of claim 26, wherein at least two of the payout zones are associated with different paytables.

42. A gaming system comprising:

at least one input device;

at least one display device;

at least one processor; and at least one memory device storing a plurality of instructions, which when executed by the at least one processor, cause the at least one processor to operate with the at least one input device and the at least one display device for each of at least two stages of play of a solitaire game, each stage of the solitaire game using 52 cards, to:

(i) provide a plurality of card field piles;

(ii) provide a card stock pile which includes a plurality of the 52 cards;

(iii) display, in response to communications received from the at least one input device, each of the plurality of the 52 cards from the card stock pile being placed in:

(a) one of the card field piles, (b) one of a plurality of payout zones, or (c) a discard pile;

(iv) display, in response to communications received from the at least one input device in accordance with a set of predefined rules for the solitaire game, at least one card from the card field piles being placed in:

(a) a different one of the card field piles, or (b) one of the plurality of payout zones;

(v) end the stage of play of the solitaire game after any of the plurality of the 52 cards remaining in the card stock pile can only be placed in the discard pile, wherein the displayed placement of the cards when each stage of play of the game ends defines one of a plurality of outcomes, the outcomes at least including:

(a) a first outcome including a first number the 52 of cards placed in the payout zones, wherein a first award is associated with the first outcome and a second award associated with the first outcome, the first and second awards associated with different stages of play of the game, (b) a second outcome including a second different number of the 52 cards placed in the payout zones, wherein a third award is associated with the second outcome and a fourth award associated with the second outcome, the third and fourth awards associated with different stages of play of the game, wherein the ratio of the first award to the first number of the 52 cards placed in the payout zones is different than the ratio of the third award to the second number of the 52 cards placed in the payout zones, and the ratio of the second award to the first number of the 52 cards placed in the payout zones is different than the ratio of the fourth award to the second number of the 52 cards placed in the payout zones, and (c) a third outcome including a third number of the 52 cards placed in the payout zones, said third number being different than said first number and different than said second number, and wherein a fifth award is associated with the third outcome and a sixth award associated with the third outcome, the fifth and sixth awards associated with different stages of play of the game, wherein the ratio of the fifth award to the third number of the 52 cards placed in the payout zones is different than the ratio of the first award to the first number of the 52 cards placed in the payout zones, the ratio of the fifth award to the third number of the 52 cards placed in the payout zones is different than the ratio of the third award to the second number of the 52 cards placed in the payout zones, the ratio of the sixth award to the third number of the 52 cards placed in the payout zones is different than the ratio of the second award to the first number of the 52 cards placed in the payout zones, the ratio of the sixth award to the third number of the 52 cards placed in the payout zones is different than the ratio of the fourth award to the second number of the 52 cards placed in the payout zones; and (vi) provide any award associated with the displayed outcome.

43. The gaming system of claim 42, wherein the plurality of instructions, when executed by the at least one processor, cause the at least one processor to operate with the at least one input device and the at least one display device to initiate advancement to a subsequent stage of play of the solitaire game if a predetermined event occurs.

44. The gaming system of claim 42, wherein the plurality of instructions, when executed by the at least one processor, cause the at least one processor to operate with the at least one display device to display, in response to communications received from the at least one input device, each of the plurality of the 52 cards from the card stock pile being placed in the card field piles, wherein cards placed in the card field piles are placed in the respective card field piles in a descending sequence.

45. The gaming system of claim 42, wherein the plurality of instructions, when executed by the at least one processor, cause the at least one processor to operate with the at least one display device to display, in response to communications received from the at least one input device, each of the plurality of the 52 cards from the card stock pile being placed in the card field piles, wherein cards placed in the card field piles are placed in the respective card field piles in a descending sequence, and alternating card color.

46. The gaming system of claim 42, wherein the plurality of instructions, when executed by the at least one processor, cause the at least one processor to operate with the at least one display device to display, in response to communications received from the at least one input device, each of the plurality of the 52 cards from the card stock pile being placed in one of the plurality of payout zones, wherein cards placed in the payout zones are placed in each respective payout zone in ascending sequence.

47. The gaming system of claim 42, wherein the plurality of instructions, when executed by the at least one processor, cause the at least one processor to operate with the at least one display device to automatically move each card from the stock pile to the discard pile and display, in response to communications received from the at least one input device, each of a plurality of cards from the discard pile being placed in one of the card field piles or one of the plurality of payout zones.

48. The gaming system of claim 42, wherein the plurality of instructions, when executed by the at least one processor, cause the at least one processor to operate with the at least one display device, to display cards from the card stock pile one at a time.

49. The gaming system of claim 42, wherein the plurality of instructions, when executed by the at least one processor, cause the at least one processor to operate with the at least one display device, to display cards from the card stock pile three at a time.

50. The gaming system of claim 42, wherein each of the payout zones is associated with a different paytable.

51. The gaming system of claim 42, at least two of the payout zones are associated with different paytables.

52. A gaming system comprising:

at least one input device;

at least one display device;

at least one processor; and at least one memory device storing a plurality of instructions, which when executed by the at least one processor, cause the at least one processor to operate with the at least one input device and the at least one display device to, for a play of a solitaire game using 52 cards:

(i) provide a plurality of card field piles;

(ii) provide a card stock pile which includes a plurality of the 52 cards;

(iii) display, in response to communications received from the at least one input device, each of the plurality of the 52 cards from the card stock pile being placed in:

(a) one of the card field piles, (b) one of a plurality of payout zones, or (c) a discard pile;

(iv) display, in response to communications received from the at least one input device in accordance with a set of predefined rules for the solitaire game, at least one card from the card field piles being placed in:

(a) a different one of the card field piles, or (b) one of the plurality of the payout zones;

(v) end the play of the solitaire game after any of the plurality of the 52 cards remaining in the card stock pile can only be placed in the discard pile, wherein the displayed placement of the cards when the game ends defines one of a plurality of outcomes, the outcomes at least including:

(a) a first outcome including a first range of the 52 cards placed in the payout zones, wherein a first award is associated with the first outcome, (b) a second outcome including a second different range of the 52 cards placed in the payout zones, wherein a second different award is associated with the second outcome, the second award being greater than the first award, the ratio of the first award to the first range of the 52 cards placed in the payout zones being different than the ratio of the second award to the second range of the 52 cards placed in the payout zones, and the number of cards placed in the payout zones in the second range being greater than the number of cards placed in the payout zones in the first range, and (c) a third outcome including a third different range of the 52 cards placed in the payout zones, said third different range being different than said first range and different than said second range, wherein a third award is associated with the third outcome, wherein the ratio of the third award to the third range of the 52 cards placed in the payout zones is different than the ratio of the first award to the first range of the 52 cards placed in the payout zones and different than the ratio of the second award to the second range of the 52 cards placed in the payout zones, and wherein the plurality of outcomes each associated with an award which in part defines a paytable, wherein the paytable includes, for a 100 credit wager:

(1) a 100 credit award associated with 0 of the 52 cards placed in the payout zones;

(2) a 35 credit award associated with a range of 5 to 9 of the 52 cards placed in the payout zones;

(3) a 50 credit award associated with a range of 10 to 14 of the 52 cards placed in the payout zones;

(4) a 100 credit award associated with a range of 15 to 19 of the 52 cards placed in the payout zones;

(5) a 200 credit award associated with a range of 20 to 24 of the 52 cards placed in the payout zones;

(6) a 400 credit award associated with a range of 25 to 29 of the 52 cards placed in the payout zones;

(7) a 750 credit award associated with a range of 30 to 34 of the 52 cards placed in the payout zones;

(8) a 1,000 credit award associated with a range of 35 to 49 of the 52 cards placed in the payout zones; and (9) a 2,000 credit award associated with a range of 50 to 52 of the 52 cards placed in the payout zones;

(vi) provide any award associated with the displayed outcome.

* * * * *

UNITED STATES PATENT AND TRADEMARK OFFICE

CERTIFICATE OF CORRECTION

PATENT NO. : 8,328,614 B2
APPLICATION NO. : 12/104053
DATED : December 11, 2012
INVENTOR(S) : Aaron T. Jones et al.

It is certified that error appears in the above-identified patent and that said Letters Patent is hereby corrected as shown below:

IN THE CLAIMS

In Claim 1, Column 28, Line 41, between the second instance of "the" and "game" insert --solitaire--.
In Claim 1, Column 28, Line 50, replace the first instance of "the" with --a--.
In Claim 1, Column 28, Line 52, replace the first instance of "the" with --a--.
In Claim 1, Column 28, Line 61, replace the first instance of "the" with --a--.
In Claim 1, Column 29, Line 4, between "percentage" and "less" insert --to--.
In Claim 2, Column 29, Line 9, delete the first instance of "the".
In Claim 2, Column 29, Line 10, delete the second instance of "the".
In Claim 2, Column 29, Line 11, delete the third instance of "the".
In Claim 2, Column 29, Line 13, delete "the".
In Claim 3, Column 29, Line 19, delete "the".
In Claim 3, Column 29, Line 20, delete the second instance of "the".
In Claim 3, Column 29, Line 21, delete the third instance of "the".
In Claim 3, Column 29, Line 23, delete the first instance of "the".
In Claim 3, Column 29, Line 24, delete the second instance of "the".
In Claim 4, Column 29, Line 28, delete "the".
In Claim 17, Column 30, Line 18, replace the second instance of "the" with --a--.
In Claim 18, Column 30, Line 26, between "wherein" and "cards" insert --the--.
In Claim 19, Column 30, Line 35, between "wherein" and "cards" insert --the--.
In Claim 20, Column 30, Line 44, between "wherein" and "cards" insert --the--.
In Claim 22, Column 30, Line 59, delete ",".
In Claim 23, Column 30, Line 64, delete ",".
In Claim 26, Column 31, Line 27, delete the second instance of "the".
In Claim 26, Column 31, Line 31, between the second instance of "the" and "game" insert --solitaire--.
In Claim 26, Column 31, Line 42, replace the second instance of "the" with --a--.
In Claim 26, Column 31, Line 44, replace "the" with --a--.
In Claim 26, Column 31, Line 46, replace the second instance of "the" with --a--.
In Claim 26, Column 31, Line 48, replace the first instance of "the" with --a--.

Signed and Sealed this
Fifteenth Day of July, 2014

Michelle K. Lee

Michelle K. Lee
*Deputy Director of the United States Patent and Trademark Office*

IN THE CLAIMS

In Claim 26, Column 31, Line 56, replace the second instance of “the” with --a--.
In Claim 26, Column 31, Line 60, replace the second instance of “the” with --a--.
In Claim 26, Column 31, Line 67, between “percentage” and “less” insert --of--.
In Claim 27, Column 32, Line 4, delete “the”.
In Claim 31, Column 32, Line 16, between “the” and “game” insert --solitaire--.
In Claim 32, Column 32, Line 37, between “the” and “game” insert --solitaire--.
In Claim 33, Column 32, Line 58, between “the” and “game” insert --solitaire--.
In Claim 34, Column 33, Line 17, between “wherein” and “cards” insert --the--.
In Claim 35, Column 33, Line 26, between “wherein” and “cards” insert --the--.
In Claim 36, Column 33, Line 35, between “wherein” and “cards” insert --the--.
In Claim 38, Column 33, Line 50, delete “,”.
In Claim 39, Column 33, Line 55, delete “,”.
In Claim 42, Column 34, Line 23, between “the” and “game” insert --solitaire--.
In Claim 42, Column 34, Line 25, between “number” and “the” insert --of--.
In Claim 42, Column 34, Line 25, delete “of”.
In Claim 42, Column 34, Line 28, between “award” and “associated” insert --is--.
In Claim 42, Column 34, Line 30, between “the” and “game” insert --solitaire--.
In Claim 42, Column 34, Line 34, between “award” and “associated” insert --is--.
In Claim 42, Column 34, Line 36, between “the” and “game” insert --solitaire--.
In Claim 42, Column 34, Line 37, replace the first instance of “the” with --a--.
In Claim 42, Column 34, Line 39, replace the first instance of “the” with --a--.
In Claim 42, Column 34, Line 41, replace the first instance of “the” with --a--.
In Claim 42, Column 34, Line 43, replace the first instance of “the” with --a--.
In Claim 42, Column 34, Line 51, between “award” and “associated” insert --is--.
In Claim 42, Column 34, Line 53, between the first instance of “the” and “game” insert --solitaire--.
In Claim 42, Column 34, Line 53, replace the second instance of “the” with --a--.
In Claim 42, Column 34, Line 61, replace the second instance of “the” with --a--.
In Claim 42, Column 34, Line 65, between “,” and the second instance of “the” insert --and--.
In Claim 44, Column 35, Line 17, between “wherein” and “cards” insert --the--.
In Claim 45, Column 35, Line 26, between “wherein” and “cards” insert --the--.
In Claim 46, Column 35, Line 35, between “wherein” and “cards” insert --the--.
In Claim 47, Column 35, Lines 41 to 42, between “the” and “stock” insert --card--.
In Claim 48, Column 35, Line 50, delete “,”.
In Claim 49, Column 35, Line 55, delete “,”.
In Claim 52, Column 36, Line 22, between the second instance of “the” and “game” insert --solitaire--.
In Claim 52, Column 36, Line 33, replace the second instance of “the” with --a--.
In Claim 52, Column 36, Line 35, replace the first instance of “the” with --a--.
In Claim 52, Column 36, Line 37, replace the second instance of “the” with --a--.
In Claim 52, Column 36, Line 39, replace the first instance of “the” with --a--.
In Claim 52, Column 36, Line 47, replace the first instance of “the” with --a--.
In Claim 52, Column 36, Line 54, between “outcomes” and “each” insert --are--.
In Claim 52, Column 38, Line 2, after “zones;” insert --and--.